US006024085A

United States Patent [19]

Hodge et al.

[11] Patent Number: 6,024,085

[45] Date of Patent: Feb. 15, 2000

[54] MODULAR FIREPLACE

[76] Inventors: Deborah L. Hodge; James Roe Hodge, Jr., both of 4880 Northside Dr. NW., Atlanta, Ga. 30327

[21] Appl. No.: 09/121,771

[22] Filed: Jul. 23, 1998

[51] Int. Cl.[7] ..... F24B 1/18

[52] U.S. Cl. ..... 126/500; 126/8; 126/25 R; 110/336; 110/338

[58] Field of Search ..... 126/25 R, 9 R, 126/8, 500; 110/336, 338

[56] References Cited

U.S. PATENT DOCUMENTS

| | | | |
|---|---|---|---|
| 327,396 | 9/1885 | Jones . | |
| 372,774 | 11/1887 | Story . | |
| 570,995 | 11/1896 | Horner | 110/336 |
| 926,910 | 7/1909 | Taylor . | |
| 933,774 | 9/1909 | Maschino . | |
| 945,596 | 1/1910 | Prendergast . | |
| 945,597 | 1/1910 | Prendergast . | |
| 1,069,644 | 8/1913 | Newton . | |
| 1,069,944 | 8/1913 | Haggard | 126/500 |
| 1,170,936 | 2/1916 | Royse . | |
| 1,297,652 | 3/1919 | Brunner . | |
| 1,758,459 | 5/1930 | Mooney . | |
| 2,311,366 | 2/1943 | Carey | 126/25 R |
| 2,473,018 | 6/1949 | Edwards . | |
| 2,916,983 | 12/1959 | Kinkead . | |
| 3,201,907 | 8/1965 | Henderson . | |
| 3,232,777 | 2/1966 | Bush . | |
| 3,358,909 | 12/1967 | Mansson et al. . | |
| 3,998,203 | 12/1976 | Jensen . | |
| 4,232,652 | 11/1980 | Serwatowski . | |
| 4,259,824 | 4/1981 | Lopez . | |
| 4,329,976 | 5/1982 | Jackson . | |
| 4,384,566 | 5/1983 | Smith . | |
| 4,470,399 | 9/1984 | Pitha . | |
| 4,478,208 | 10/1984 | Pitha . | |
| 4,686,807 | 8/1987 | Newsome . | |
| 4,805,591 | 2/1989 | Pitha . | |
| 4,947,826 | 8/1990 | Miceli . | |
| 4,984,562 | 1/1991 | Pedersen et al. . | |
| 5,017,232 | 5/1991 | Miceli . | |
| 5,186,161 | 2/1993 | Shumock . | |

*Primary Examiner*—Carroll Dority
*Attorney, Agent, or Firm*—Needle & Rosenberg, P.C.

[57] ABSTRACT

The present invention encompasses a modular fireplace having a first side wall, a second side wall, and a back wall that is contiguous with the first side wall and the second side wall and defines an interior open-faced firebox region having a substantially "U" shape in top plan view. The first side wall is constructed from a plurality of sequentially stacked modular first side blocks and the second side wall is formed from a plurality of sequentially stacked modular second side blocks. The back wall has a first modular corner block, a second modular corner block, and at least one substantially vertical spacer block that are joined so that the first corner block and the second corner block are contiguous with the spacer block. To aid in the efficient drafting of the fireplace, each of the spacer blocks may have a spacer block air chamber extending therein from an open upper end on the spacer block top end to a closed lower end proximate the spacer block bottom end. Further, the first corner block may have a first corner block air chamber therein extending from an open first corner block upper end on the first corner block top end to a closed first corner block lower end proximate the first corner block bottom end, and the second corner block may have a second corner block air chamber extending therein from an open second corner block upper end on the second corner block top end to a closed second corner block lower end proximate the second corner block bottom end. The modular sections of the modular fireplace are engaged in a nesting relationship that serves to orient the respective modular sections, to provide structural support to the modular sections and the modular chimney, and to provide a physical obstruction to the passage of flame, hot gases, and smoke through the joints of the modular sections when the sections are physically joined and mortared together.

35 Claims, 8 Drawing Sheets

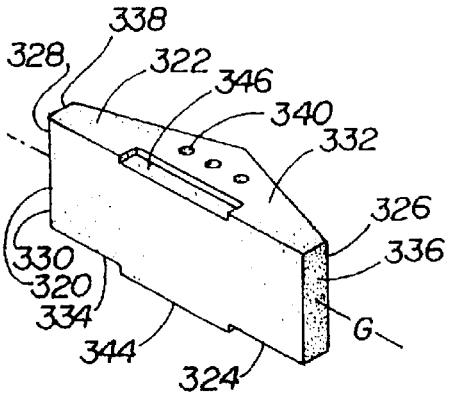
FIG 13A
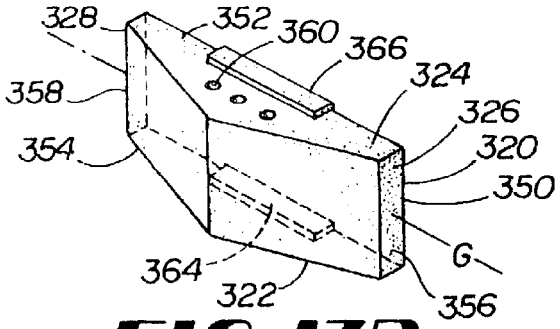
FIG 13B
FIG 14
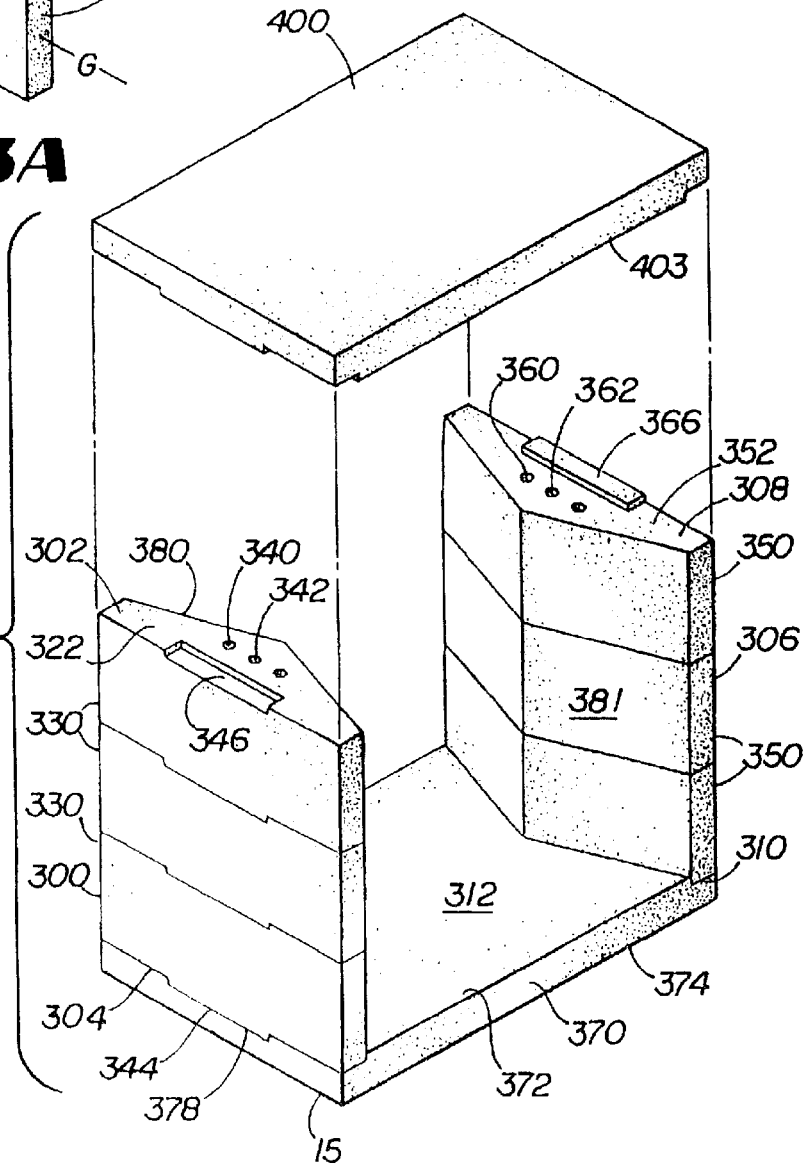

MODULAR FIREPLACE

BACKGROUND OF THE INVENTION

1. Field of the Invention

The present invention relates to modular fireplace systems and, more particularly, to a modular fireplace construction that increases the energy and drafting efficiency of the modular fireplace.

2. Background Art

The invention relates to a modular fireplace construction for application in a commercial setting or in a residential dwelling. Modular fireplace construction of an open-type fireplace in residential construction is well known. The advantage of modular fireplace construction and insulation are primary in the reduced cost of the precast fireplace sections which can be molded into small and light pieces that assemble quickly when compared to brick and masonry construction. There is also a cost savings realized through reduced labor required for construction as only one or two people may be required to move in place the lighter fireplace sections and there is no requirement for a highly paid and highly skilled masonry workers.

The following U.S. patents describe various types of modular open-fireplace construction, these include U.S. Pat. No. 5,186,161 to Schumack; U.S. Pat. No. 4,686,807 to Newsome; U.S. Pat. No. 4,984,562 to Peterson, et al.; U.S. Pat. No. 4,478,208 to Pitha; and U.S. Pat. No. 1,069,944 to Hacker. While the above-mentioned prior art modular fireplaces have an advantage over free-built structures in terms of cost savings both in material and labor, the prior art modular fireplaces are typically difficult to assemble because the individual sections are not easy to handle and many pieces appear almost identical. Additionally, the above-mentioned modular fireplaces have one constant failing, that is, they sacrifice the heating and drafting efficiency of the modular fireplace due to limitations imposed by the requirement to use simply constructed modular segments for the "ease of construction." The self imposed limitation in prior art modular fireplace designs thus fails to remove efficiently the smoke.

The design and construction of an efficient, functional fireplace requires adherence to some basic rules concerning dimensions and the placement of various component parts. The objectives of a correctly designed fireplace are to: (1) assure proper combustion of the fuel; (2) deliver smoke and other products of combustion up the chimney; (3) radiate the maximum amount of heat into the room; and (4) afford simplicity and fire safety in construction. One of the best fireplaces, to keep warm with minimum consumption of wood fuel, was developed over two hundred years ago after countless generations of heating with wood and is known as a Rumford fireplace. Count Rumford achieved the objectives of a correctly designed fireplace by designing his fireplace around four basic principles: bum the fire hot and fast in a shallow firebox, channel the hot flu gases through a mass of masonry designed to absorb the heat, radiate as much heat energy from the masonry mass as possible, and increase the efficiency of the draw of the fireplace. The hotter the fire, the more efficient this conversion process becomes, and the more stored energy in the wood is converted into heat. When the hot flu gases are then channeled through several tons of masonry, through properly designed flu passages, most of this heat can be absorbed and stored by the masonry. Stored heat will then be radiated to adjacent living space over a period of many hours.

The fireplace must both contain the fire and draw the smoke up through the chimney to the outside. Efficiency in removing the smoke is of prime importance and the dimensional ratios among the size of the firebox area, the smoke chamber, and the chimney flue will directly affect the efficiency of the fireplace if any of the ratios are improper. Other factors which affect the efficiency of the drawing ability of a fireplace are atmospheric conditions and the materials used. For example, a fireplace that drafts well at sea level may not draft as well at a higher altitude due to lower barometric pressure. Likewise, a fireplace constructed all or in part of metal will be a colder fireplace than one made of a refractory ceramic or cement, and will draft less efficiently.

Modular fireplaces, although more expensive than the various metal fireplace units that have been used by builders to facilitate fireplace construction, provide heating efficiency and safety improvements over the prior art metal fireplace units. A metal fireplace provides a functionally effective design form that is easily surrounded by masonry, faced with masonry veneer, and surrounded by a chimney. Highly skilled masons knowledgeable in fireplace construction are not needed and much of the guess work is eliminated from the construction of masonry fireplaces. Unfortunately, metal fireplaces are typically not durable, and depending on climatic conditions and the nature of the wood burned therein, rarely last as long as 25 years, and generally fail on average within 7 to 10 years. When a metal firebox fails, it typically results in metal corrosion around the point of failure which makes the metal fireplace a safety hazard and not useful until the defect is corrected. Repairing this defect is a very expensive procedure. A metal fireplace also lacks the masonry mass that allows the modular fireplace to efficiently store and radiate the heat energy of the fire and, as stated above, can result in problems due to inadequate drawing, which are especially aggravated in high altitude or multistory applications.

Consequently, there exists a need in the art for a fireplace, such as a modular fireplace construction, that is structurally integrated to provide a substantially smoke leak-proof seal through the joints of the modular fireplace, while efficiently radiating heat into the adjoining space. Further there is a need in the art for a modular fireplace that increases the efficiency of the draw of the fireplace to allow for the proper combustion of the fuel and the efficient delivery of smoke and other products of combustion up the chimney while also providing ease of construction, enhanced fire safety and life expectancy of the fireplace construction.

SUMMARY OF THE INVENTION

The present invention satisfies these and other needs in the art by providing an improved modular fireplace construction that increases the energy and drawing efficiency of the modular fireplace. The shape and size of the modular sections also ensures that the connection between the individual sections will be secure and that the interior surface of the fireplace is smooth and free of obstructions.

The first embodiment of the modular fireplace of the present invention has a first side wall, a second side wall, opposed to the first side wall, and a back wall. The first side wall is formed from a plurality of sequentially stacked modular first side blocks and the second side wall is formed from a plurality of sequentially stacked modular second side blocks. The upper surface of each side block is sized so that at least a portion of the lower surface of an adjoining side block can be complementarily engaged, thereby forming a substantially fire and smoke leak-proof seal therebetween when the side blocks are sequentially stacked and mortared together to form the first and second plurality of modular side blocks.

The back wall of the fireplace has a first corner block that is joined to at least one spacer block which, in turn, is joined to a second corner block to form a contiguous back wall. The back wall is contiguously joined to the first and the second side walls, and defines an interior open-faced firebox region having a "U" shape, when the first corner block is disposed and mortared onto the first side wall and the second corner block is disposed and mortared onto the second side wall. The complementary sizes and shapes of the proximal and distal surfaces of the spacer blocks, the side blocks, and the first and second corner blocks ensures that the back wall and the first and second side walls have a substantially smoke and fire leak-proof seal when the spacer blocks, the side blocks and the corner blocks are joined and mortared together.

Each spacer block has a vertically elongated spacer block air chamber extending therein from an open upper end on the spacer block top end to a closed lower end near the spacer block bottom end. In addition to the plurality of spacer block air chambers that result from the multiple use of spacer blocks in the fireplace construction, it is preferred that both the first and second corner blocks have similar air chambers because the more air chambers that are present in a given fireplace, the greater the improvement in drafting efficiency of the fireplace. Thus, preferably, both the first and second corner blocks have has a corner block air chamber extending therein from the respective corner block's top end to the respective corner block's bottom end. The air chambers are structured so that heat from the fire in the firebox region may be transferred to the air chambers through the walls of the fireplace. To maximize the efficiency of the heat transfer from the firebox to the air chambers, the air chambers are located within their respective blocks as near to the interior of the firebox as structurally feasible.

To aid in the placement of the side blocks and the spacer blocks and to aid in forming a substantially leak-proof seal between the respective blocks that provides a physical obstruction to the passage of flame or smoke, each side block and spacer block has a male protrusion extending from one of the mating surfaces of the block and a female indentation in the opposing mating surface of the block. The male protrusion is sized to complementarily engage one female indentation so that the blocks may be sequentially engaged.

The engagement of the first side blocks forming the first side wall and the first corner block results in an overlapping joint that extends substantially from the top end of the first corner block to the bottom end of the first corner block. Similarly, the engagement of the second side blocks forming the second side wall and the second corner block results in an overlapping joint extending substantially from the top end of the second corner block to the bottom end of the second corner block. These overlapping joints aid in the placement of the first and second corner blocks onto the respective first and second side walls, help to structurally support the fireplace, and provide a physical obstruction that aids in providing a substantially smoke and fire leak-proof seal when the first corner block is joined to the first side wall and the second corner block is joined to the second side wall.

The fireplace is preferably erected on a noncombustible base with a noncombustible hearth extension in front of the firebox region. The noncombustible base may be a concrete slab or it may preferably be a base plate. The upper surface of the base plate is preferably sized to complementarily engage the bottom surfaces of the first side wall, the second side wall, and the back wall.

The fireplace preferably also includes a smoke lip spanning the opening of the firebox region in order to aid in containing smoke and combustion by-products within the firebox region as well as to provide structural support for a portion of a smoke chamber that is disposed onto the firebox region. The inner surface of the smoke lip is disposed onto the proximal ends of the first and second side blocks that form the uppermost course of the first and second side walls. When fixed onto the uppermost course of the first and second side walls, the smoke lip spans the interior of the open-faced firebox region from the top surface of the first side wall to the top surface of the second side wall and, in conjunction with the first and second side walls and the back wall, defines a firebox exhaust opening that is in fluid communication with the interior firebox region.

A smoke chamber throat is preferably disposed onto the top surfaces of the first side wall, the second side wall, the back wall, and the outer surface of the smoke lip. The smoke chamber throat substantially covers the firebox exhaust opening to further enhance the drawing efficiency of the fireplace construction by acting to accelerate the flow of the combustion products out of the firebox region and the exhaust opening. The smoke chamber throat has a throat opening, in fluid communication with the firebox exhaust opening, extending therethrough between the top surface of the smoke chamber throat and the bottom surface of the smoke chamber throat.

A smoke chamber is preferably provided to funnel the products of combustion to a chimney. The smoke chamber defines an interior smoke chamber region void which is in communication with a smoke chamber exhaust opening that is defined by the top surface of the smoke chamber and with the firebox exhaust opening. Alternatively, if a smoke chamber throat is used, the interior smoke chamber region void is in communication with the smoke chamber exhaust opening and the throat opening. The smoke chamber acts to funnel the products of combustion emanating from the firebox exhaust opening upwards toward the smoke chamber exhaust opening.

The first and second corner block air chambers, and the plurality of spacer block air chambers are also in fluid communication with the interior smoke chamber region void. By allowing the air chambers to open directly into the void of the smoke chamber, the drafting efficiency of the fireplace is increased by replacing the relatively cooler air in the smoke chamber with higher efficiency high temperature air. The air chambers provide a quantity of high temperature air directly into the smoke chamber, where it immediately rises into and through the fireplace chimney which increases both the flow rate and the volume of air and smoke drawn from the firebox region. Since the preferred design of the air chambers is not open to the outside of the fireplace, only the relatively cool air from the interior void of the smoke chamber is drawn down into the air chambers to replace the high temperature air rising from the interiors of the air chambers. As the relative width of the fireplace increases, the number of spacer block air chambers correspondingly increases as more spacer blocks are utilized in the construction of the back wall of the fireplace.

The fireplace of the first embodiment also preferably has a fireplace top plate disposed onto the top surface of the smoke chamber. The top plate has a top plate bore, in fluid communication with the smoke chamber exhaust opening, extending through the top plate between the top plate upper surface and the top plate lower surface. The fireplace construction of the first embodiment is complete when a chimney is fixed onto the upper surface of the top plate.

The construction of the second embodiment is similar to the first embodiment and encompasses a modular fireplace having a firebox top . The firebox top has a firebox top lower surface that is disposed onto the top surfaces of the first side wall, the second side wall, and the back wall so that the interior firebox region is enclosed. This results in a vent-free modular fireplace construction. The first side wall, the second side wall, the back wall, and the base, if used, are assembled from the same modular blocks described in the first embodiment. The second embodiment of the present invention is intended for use with any fireplace application, such as a gas line fireplace, that does not require the use of an exhaust vent.

The third embodiment of the present invention allows an outside observer to see through the firebox region so that the fire within the firebox of the see-through modular fireplace may be seen from two separate rooms. The construction of the third embodiment of the fireplace is similar to the first embodiment and the smoke chamber throat, if used, the base plate, if used, the smoke chamber, the fireplace top plate, and the chimney of the third embodiment of the present invention are substantially equivalent to the first embodiment.

The third embodiment has a first side wall and a second side wall. The first side wall and the second side wall face each other and are spaced apart and define an interior firebox region that is open-faced on two sides. The first side wall is composed of a plurality of sequentially stacked modular first side blocks. The second side wall, like the first side wall, is formed from a plurality of sequentially stacked modular second side blocks. The upper surface of each side block is sized to complementarily engage at least a portion of the lower surface of an adjoining side block so that the upper and lower side block surfaces of adjoining blocks form a substantially fire and smoke leak-proof seal therebetween when the side blocks are sequentially stacked and mortared together.

Preferably, the side block upper surface and the side block lower surface of each side block are substantially planer and parallel to each other. Each side block further has at least one block bore, and preferably a plurality of block bores, extending through the side block between the side block upper surface to the side block lower surface. When the side blocks are sequentially stacked, the block bores of each side block substantially co-axially aligns with the block bores of the other side blocks in the side walls to define at least one side block air chamber, and preferably a plurality of side block air chambers. Thus, the first side wall preferably has a plurality of first side block air chambers and the second side wall preferably has a plurality of second side block air chambers.

To aid in the placement of the side blocks and to aid in forming a substantially leak-proof seal between the side blocks, each side block has a side block male protrusion extending from one of the mating surfaces of the side block and a female indentation therein the opposing mating surface of the side block. The side block male protrusion is sized to complementarily engage one side block female indentation so that the side blocks may be sequentially stacked. The male side block protrusions and the female side block indentations of the side blocks forming the first and second side walls also provide a physical obstruction to the passage of flame or smoke through the joints of the courses of modular side blocks.

The third embodiment of the fireplace also preferably includes a pair of smoke lips spanning the openings of the firebox region in order to aid in containing smoke and combustion by-products within the firebox region as well as to provide structural support for a portion of a smoke chamber that is disposed onto the firebox region. The inner surface of one of the smoke lips is disposed onto the proximal ends of the uppermost side blocks of the first and second side walls. Similarly, the inner surface of the other smoke lip is disposed onto the distal ends of the uppermost side blocks of the first and second walls. When fixed onto the first and second side walls in this fashion, the smoke lips span the interior of the open-faced firebox region from the top surface of the first side wall to the top surface of the second side wall and, in conjunction with the first and second walls, define a firebox exhaust opening that is in fluid communication with the interior firebox region.

The smoke chamber bottom surface is disposed onto the top surface of the first side wall, the second side wall, and the outer surfaces of the first and second smoke lips. The smoke chamber defines an interior smoke chamber region void which is in fluid communication with the firebox exhaust opening and the smoke chamber exhaust opening that is defined by the smoke chamber top surface. Alternatively, if a smoke chamber throat is used, the interior smoke chamber region void is in communication with the smoke chamber exhaust opening and the throat opening. The smoke chamber acts to funnel the products of combustion emanating from the firebox exhaust opening upwards toward the smoke chamber exhaust opening. The top plate and the chimney used in the third embodiment are substantially equivalent to the first embodiment of the present invention.

The first and second plurality of air chambers are also in fluid communication with the interior smoke chamber region void. As noted in the discussion of the first embodiment, by allowing the air chambers to be open directly into the interior void of the smoke chamber, the drafting efficiency of the fireplace is increased by replacing the relatively cooler air in the smoke chamber with higher efficiency high temperature air. The air chambers provide a quantity of high temperature air directly into the smoke chamber where it immediately rises into and through the fireplace chimney which increases both the flow rate and the volume of air and smoke drawn from the firebox.

The construction of the fourth embodiment of the fireplace is similar to the third embodiment and encompasses a modular fireplace having a see-through firebox region that has a firebox top having a firebox lower surface that is disposed onto the top surface of the first and second side walls, and, optionally, the outer surfaces of the first and second smoke lips. The addition of the firebox top encloses the interior firebox region so that a vent-free modular fireplace is constructed. The first side wall, the second side wall, and the base, if used, are assembled from the same modular blocks described in the third embodiment. The fourth embodiment of the present invention is intended for use with any fireplace application, such as a gas line fireplace, that does not require the use of an exhaust vent.

In order to reduce the weight of the blocks, and thereby reduce the labor expense of the modular fireplace by reducing the number of people required to move and position the blocks forming the fireplace, a lightweight concrete composition is preferably utilized for the modular components of the fireplace of the present invention. Additionally, all of the joints of the modular fireplace of the present invention are mortared to aid in providing a substantially smoke and flame leak-proof seal.

Thus, the present invention provides an improved modular fireplace construction that is easy to assemble, without the need for skilled artisans, and increases the energy and drawing efficiency of the modular fireplace.

BRIEF DESCRIPTION OF THE FIGURES OF THE DRAWINGS

FIG. 13A is a perspective view of the modular side block forming the first stacked plurality of modular side blocks of the third embodiment of the present invention shown in FIG. 12 showing a plurality of first block bores FIG. 13B is a perspective view of the modular side block forming the second stacked plurality of modular side blocks of the third embodiment of the present invention shown in FIG. 12 showing a plurality of second block bores.

FIG. 14 is a perspective view of a fourth embodiment of the present invention showing a fire box top disposed onto the upper surfaces of the first side wall and the second side wall.

DETAILED DESCRIPTION OF THE INVENTION

The present inventions is more particularly described in the following examples that are intended as illustrative only since numerous modifications and variations therein will be apparent to those skilled in the art. As used in the specification and in the claims, "a" can mean one or more, depending upon the context in which it is used.

The present invention provides an improved modular fireplace 10 that increases the energy and drawing efficiency of the modular fireplace 10. The modular fireplace 10 reduces labor and installation time by providing modular sections whose shape and size make it readily apparent to the assembler how, and in what order, the individual sections are connected. The shape and size of the modular sections also ensures that the connection between the individual sections will be secure and that the interior surface of the fireplace 10 is smooth and free of obstructions. Simplicity, ease of assembly, and reduced labor costs are also achieved by the use of easy to handle modular sections that may be positioned in place by one or two laborers that are not required to be skilled masonry artisans.

Figure 1:
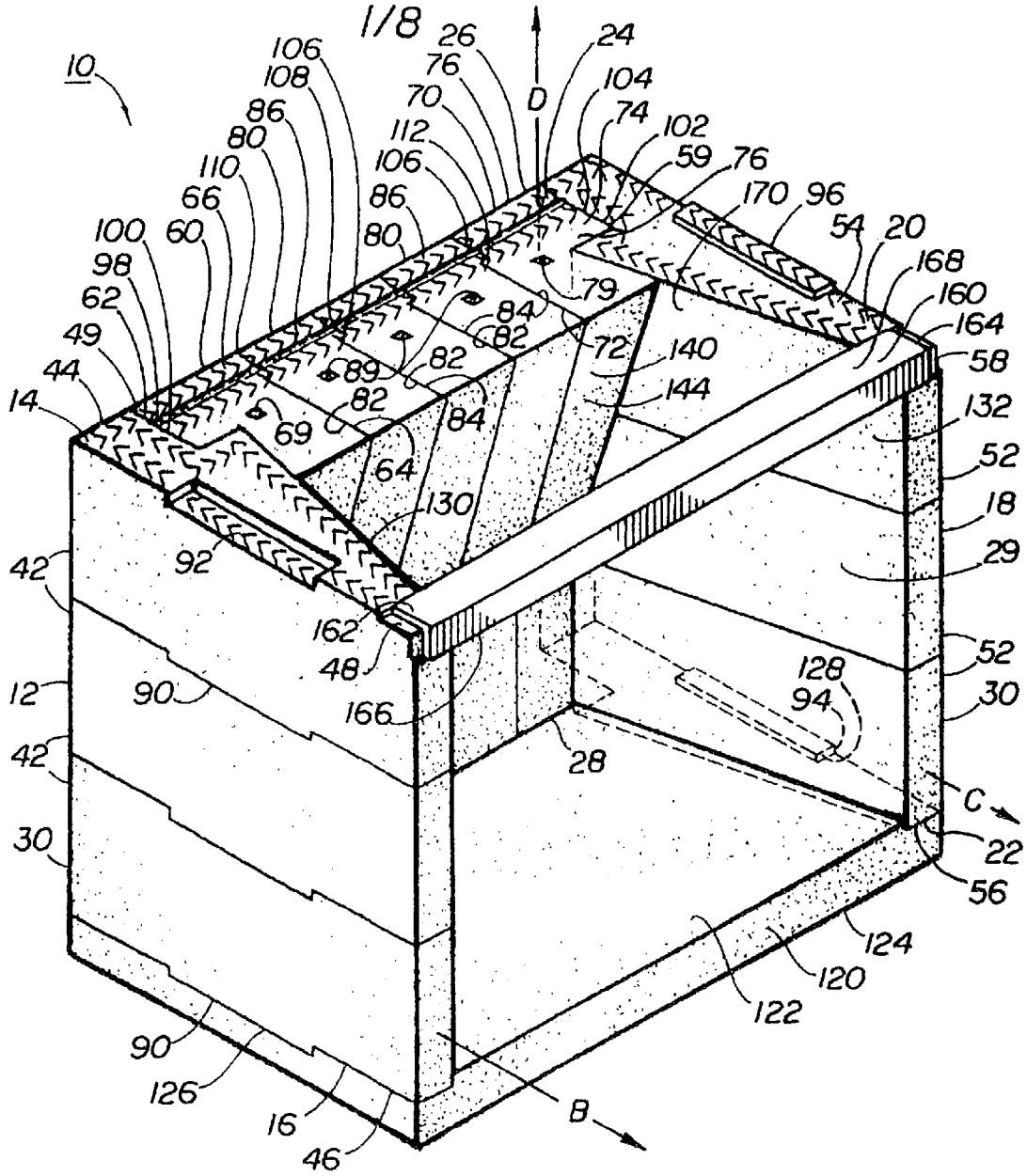
FIG. 1 is a perspective view of the first embodiment of the present invention showing a first side wall of a first stacked plurality of modular side blocks, a second side wall of a second stacked plurality of modular side blocks, a back wall of a first corner block, a second corner block, and a plurality of spacer blocks, a base, and a smoke lip defining an interior firebox region with a firebox exhaust opening.

Referring to FIG. 1, the first embodiment of the modular fireplace 10 of the present invention has a first side wall 12, having a first side wall top surface 14 and a first side wall bottom surface 16, a second side wall 18, that is opposed to the first side wall 12, having a second side wall top surface 20 and a second side wall bottom surface 22, and a back wall 24, having a back wall top surface 26 and a back wall bottom surface 28. The back wall 24 is contiguously joined to the first side wall 12 and the second side wall 18, and defines an interior open-faced firebox region 29 having a substantially"U" shape from a top plan cross-sectional view.

Figure 4B:
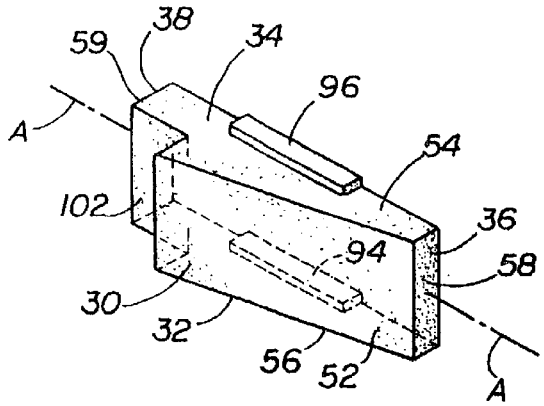
FIG. 4B is a perspective view of the modular side block that is oriented and used to form the second stacked plurality of modular side blocks that forms the second side wall.
Figure 4A:
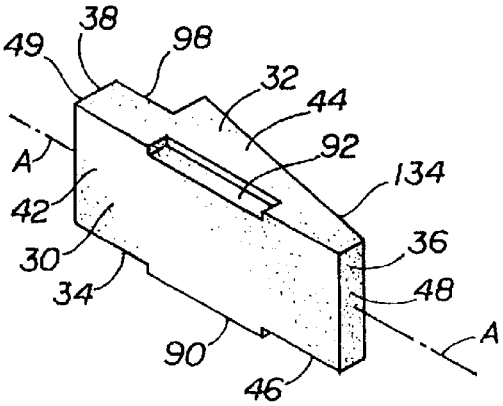
FIG. 4A is a perspective view of a modular side block that is used to form the first stacked plurality of modular side blocks that forms the first side wall.

The first side wall 12 is formed from a plurality of sequentially stacked modular first side blocks 42. The second side wall 18 is formed from a plurality of sequentially stacked modular second side blocks 52. As best shown in FIGS. 4A and 4B, the modular side block 30 that is used in the first and second side walls 12, 18 has a side block upper surface 32, an opposed side block lower surface 34, a side block proximal end 36, and an opposed first side block distal end 38. The side block upper surface 32 of the side block 30 is of a size to be complementarily engaged by at least a portion of the side block lower surface 34 of an adjoining side block 30, so that the side block upper surface 32 and the side block lower surface 34 form a substantially fire and smoke leak-proof seal therebetween when the side blocks 30 are sequentially stacked on top of each other.

For clarity, the modular side blocks 30 that form the first and second side walls 12, 18 will be described as a first side block 42 and a second side block 52, but, as one skilled in the art will appreciate, the modular side block 30 that forms the first side wall 12 is the same modular side block 30 that is used to form the second side wall 18. The blocks 30 are merely rotated 180 degrees around a longitudinal axis A extending from the side block proximal end 36 to the side block distal end 38 so that the modular block upper surface 32 of the modular side block 30 used in the first side wall 12 becomes the modular block lower surface 34 of the modular side block 30 used to form the second side wall 18.

Referring back to FIGS. 1 and 4A, each first side block 42 has a first side block upper surface 44, an opposed first side block lower surface 46, a first side block proximal end 48, and an opposed first side block distal end 49. The first side wall top surface 14 is formed by the first side block upper surface 44 of the first side block 42 of the top, or uppermost, course of the first side wall 12, and the first side wall bottom surface is formed by the first side block lower surface 46 of the first side block 42 of the first course of the first side wall 12.

Similarly, referring now to FIG. 4B, each second side block 52 has a second side block upper surface 54, an opposed second side block lower surface 56, a second side block proximal end 58, and an opposed second side block distal end 59. The second side wall top surface 20 is formed by the second side block upper surface 54 of the second side block 52 of the top, or uppermost, course of the second side wall 18, and the second side wall bottom surface 22 is formed by the second side block lower surface 56 of the second side block 52 of the first course of the second side wall 18. The upper side block surfaces 44, 54 of the first and second side blocks 42, 52 are of a size to be complementarily engaged by at least a portion of the lower surfaces 46, 56 of an adjoining first or second side block 42, 52 to form a substantially fire and smoke leak-proof seal therebetween when the first side blocks 42 or the second side blocks 52 are sequentially stacked and mortared together to form the respective first and second side walls 12, 18.

Figure 5:
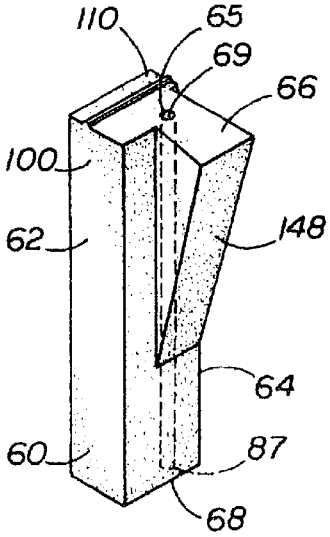
FIG. 5 is a perspective view of a first modular corner block showing a first modular corner block air chamber.

Referring to FIGS. 1 and 5, the back wall 24 of the fireplace 10 has a first corner block 60 joined to at least one spacer block 80 which, in turn, is joined to a second corner block 70 to form a contiguous back wall 24. The first corner block 60 has a first corner block proximal surface 62, an opposed first corner block distal surface 64, a first corner block top end 66 and an opposed first corner block bottom end 68. The first corner block proximal surface 62 of the first corner block 60 is of a size to be complementarily engaged by at least a portion of the first side block distal end 49 of at least one of the first side blocks 42 forming the first side wall 12 so that a first "L" shaped corner is defined, from a top plan cross-sectional view, when the first corner block 60 is disposed and mortared onto the first side wall 12 to provide a substantially fire and smoke leak-proof seal therebetween.

Figure 6:
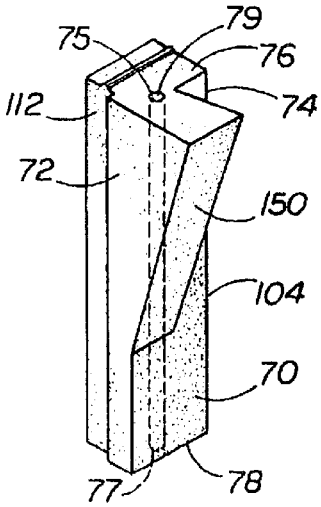
FIG. 6 is a perspective view of a second modular corner block showing a second modular corner block air chamber.

Now referring to FIGS. 1 and 6, similar to the relationship of the first corner block 60 and the first side wall 12, the second corner block 70 has a second corner block proximal surface 72, an opposed second corner block distal surface 74, a second corner block top end 76, and an opposed second corner block bottom end 78. The second corner block distal surface 74 of the second corner block 70 is of a size to be complementarily engaged by at least a portion of the second side block distal end 59 of at least one of the second side blocks 52 forming the second side wall 18 so that a second "L" shaped corner, from a top plan cross-sectional view, opposed to the first "L" shaped corner, is defined when the second corner block 70 is disposed and mortared onto the second side wall 18.

Figure 7:
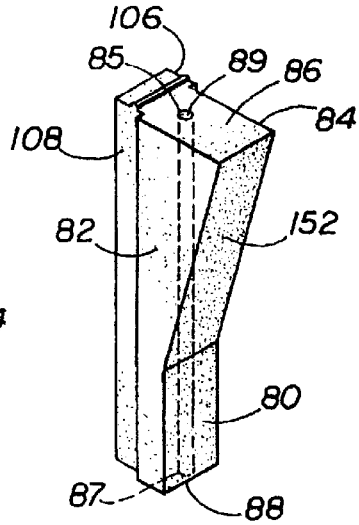
FIG. 7 is a perspective view of a modular spacer block showing a spacer block air chamber.

As shown in FIGS. 1 and 7, the first and second "L" shaped corners of the fireplace are joined by at least one spacer block 80, and preferably by a plurality of spacer blocks 81, to form the "U" shaped interior fireplace region 29 from a top plan cross-sectional view. Each of the spacer blocks 80 that span and join the first and second corner blocks 60, 70 has a spacer block proximal surface 82, an opposed spacer block distal surface 84, a spacer block top end 86 and an opposed spacer block bottom end 88. The spacer block proximal surface 82 of one spacer block 80 is sized to complementarily engage at least a portion of the spacer block distal surface 84 on one adjacent spacer block 80. The spacer block proximal surface 82 of the spacer block is also appropriately sized to complementarily engage with at least a portion of the first corner block distal surface 64, and the spacer block distal surface 84 of the spacer block is appropriately sized to complementarily engage at least a portion of the second corner block proximal surface 72. The complementary sizes and shapes of the spacer block proximal and distal surfaces 82, 84, the first corner block distal surface 64, and the second corner block proximal surface 72 ensures that the back wall has a substantially smoke and fire leak-proof seal when the first corner block 60 is joined and mortared to one of the spacer blocks 80, the spacer blocks 80 are joined and mortared together, and one of the spacer blocks 80 is joined and mortared to the second corner block 70.

The back wall top surface 26 of the back wall 24 is formed from the first corner block top end 66, the second corner block top end 76, and each spacer block top end 86. The back wall bottom surface 28 of the back wall 24 is formed from the first corner block bottom end 68, the second corner block bottom end 78, and each spacer block bottom end 88.

As shown in FIG. 7, each spacer block 80 further defines a vertically elongated spacer block air chamber 89 extending therein from an open upper end 85 on the spacer block top end 86 to a closed lower end 87 near the spacer block bottom end 88. In addition to the plurality of spacer block air chambers 89 that are found in the fireplace 10 from the multiple use of spacer blocks 80 in the fireplace construction, it is preferred that both the first corner block 60 and the second corner block 70 have similar air chambers because the more air chambers that are present in a given fireplace, the greater the drafting efficiency of the fireplace. Thus, preferably, the first corner block 60, as shown in FIG. 5, further defines a first corner block air chamber 69 extending therein from an open first corner block upper end 65 on the first corner block top end 66 to a closed first corner block lower end 87 near the first corner block bottom end 68, and the second corner block 70, as illustrated in FIG. 6, further defines a second corner block air chamber 79 extending therein from an open second corner block upper end 75 on the second corner block top end 76 to a closed second corner block lower end 77 near the second corner block bottom end 78.

The spacer block, the first corner block, and the second corner block air chambers 89, 69, 79 are preferably cylindrical in cross-section and are approximately one [1] inch in diameter. As shown in FIGS. 5–7, the air chambers 89, 79, 89 are hollow and open only at their top ends 65, 75, 85 on the top of the respective blocks 60, 70, 80. The air chambers 69, 79, 89 are structured so that the heat of the fire in the firebox region 29 is transferred to the air chambers 69, 79, 89 through the walls 12, 18, 24 of the fireplace 10. To maximize the efficiency of the heat transfer from the firebox 29 to the air chambers 69, 79, 89, the air chambers are located within their respective blocks 60, 70, 80 as near to the interior of the firebox 10 as structurally feasible.

As shown in FIGS. 1 and 4, to aid in the placement of the first side blocks 42 and to aid in forming a substantially leak-proof seal, the first side block upper surface 44 of each first side block 42 has a first side block upper surface female indentation 92 therein and the first side block lower surface 46 of each first side block 42 includes a first side block lower surface male protrusion 90 extending therefrom. The first side block lower surface male protrusion 90 is sized to complementarily engage one first side block upper female indentation 92 so that the first side blocks 42 may be sequentially stacked.

Similarly, as shown in FIGS. 1 and 5, and as one skilled in the art will expect upon noting that the first side block 42 and the second side block 52 are the same modular side block 30 with the second side block 53 simply rotated 180-degrees around the longitudinal axis A from the relative position of the first side block 42, the second side block upper surface 54 of each second side block 52 includes a second side block upper surface male protrusion 96 extending therefrom and the second side block lower surface 56 of each second side block 52 includes a second side block lower surface female indentation 94 therein. The second side block lower surface female indentation 94 is sized to complementarily engage one second side block upper male protrusion 96, so that the second side blocks 52 can be sequentially stacked. The male block protrusions 90, 96 and the female block indentations 92, 94 of the respective upper and lower surfaces 44, 46, 54, 56 of the first and second side blocks 42, 52 provide a physical obstruction to the passage of flame or smoke through the joints of the courses of modular blocks 42, 52 forming the first and second plurality of modular blocks 40, 50.

Referring to FIGS. 1 and 4, the first side block distal end 49 of each first side block 42 has a first female block indentation 98 therein, and the first corner block proximal surface 62 of the first corner block 60 includes a first corner block male protrusion 100 extending therefrom. The first corner block male protrusion 100 of the first corner block 60 is sized to complementarily engage at least one first female block indentation 98 of the first side blocks 42 forming the first side wall 12. In a similar fashion, the second side block distal end 59 of each second side block 52 has a second female block indentation 102 therein and the second corner block distal surface 74 of the second corner block 72 includes a second corner block male protrusion 104 extending therefrom. The second corner block male protrusion 104 of the second corner block 70 is sized to be complementarily engaged by at least one second female block indentation 102 of the second side blocks 52 forming the second side wall 18.

As shown in FIG. 1, the engagement of the distal end 49 of the first modular side blocks 42 forming the first side wall 12 and the first corner block proximal surface 62 of the first corner block 60 results in an overlapping joint extending substantially from the first corner block top end 66 to the first corner block bottom end 68. Similarly, the engagement of the distal end 59 of the second modular side blocks 52 forming the second side wall 18 and the second corner block distal surface 74 of the second corner block 70 results in an overlapping joint extending substantially from the second corner block top end 76 to the second corner block bottom end 78. These overlapping joints aid in the placement of the first and second corner blocks 60, 70 onto the respective first and second side walls 12, 18, help to structurally support the fireplace 10, and provide a physical obstruction that helps to provide a substantially smoke and fire leak-proof seal when the first corner block 60 is joined to the first side wall 12 and the second corner block 70 is joined to the second side wall 18.

Referring now to FIGS. 1 and 7, the spacer block proximal surface 82 of each spacer block 80 preferably includes a spacer block male protrusion 106 extending therefrom, that preferably extends substantially from the spacer block top end 86 to the spacer block bottom end 88. To complement the spacer block male protrusion 66, the spacer block distal surface 84 of each spacer block 80 includes a spacer block female indentation 108 therein, that also preferably extends substantially from the spacer block top end 86 to the spacer block bottom end 88. The complementarily sized spacer block male protrusion 106 and spacer block female indentation 108 allows the spacer block male protrusion of one spacer block 80 to be complementarily engaged to one spacer block female indentation 108 of an adjacent spacer block 80 so that the spacer blocks 80 can be integrally stacked.

Referring to FIGS. 1, 5, and 7, the first corner block distal surface 64 of the first corner block 60 also preferably includes a first corner block spacer male protrusion 110, preferably extending substantially from the first corner block top end 66 to the first corner block bottom end 68, that is sized to complementarily engage the spacer block female indentation 108 so that the first corner block 60 and one of the spacer blocks 80 can be integrally stacked with a substantially leak-proof seal when mortared therebetween. Similarly, referring to FIGS. 1, 6, and 7, the second corner block proximal surface 72 preferable includes a second corner block female indentation 112 therein, preferably extending substantially from the second corner block top end 76 to the second corner block bottom end 78, that is sized to complementarily engage one spacer block male protrusion 106 so that the second corner block 70 and one of the spacer blocks 80 can be integrally stacked with a substantially leak-proof seal when mortared therebetween.

As shown in FIGS. 1 and 4A–7, the preferred, substantially vertical, joints formed by the juncture of the first side wall 12 and the first corner block 60, the first corner block 60 and one of the spacer blocks 80, the spacer blocks 80, one of the spacer blocks 80 and the second corner block 70, and the second corner block 70 and the second side wall 18 are of a simple overlapping type extending substantially the length of the respective adjoining blocks. However, other alternative designs for the joints that provide structural support and a physical barrier to flame and smoke when mortared together are contemplated.

The fireplace is preferably erected on a noncombustible base with a noncombustible hearth extension in front of the firebox region. The noncombustible base may be a concrete slab or it may preferably be a base plate 120. As shown in FIG. 1, the base plate 120 has a base plate upper surface 122 and an opposed base plate lower surface 124. The base plate upper surface 122 sized to complementarily engage the first side wall bottom surface 16, the second side wall bottom surface 22, and the back wall bottom surface 28. In order to provide ease of assembly and a secure foundation, the base plate upper surface 122 has a base plate female indentation 126 that accepts the first side block male protrusion 90 extending from the first side block lower surface 46 of the lowermost course of the first side wall 12. The base plate upper surface 122 also has a base plate male extension 128 that is accepted within the second side block female indentation 94 of the second side block 52 of the lowermost course of the second side wall 18.

If the base plate is not used, the fireplace may be disposed onto the prepared concrete slab by using a field modification that involves the sawing off of the first side block male protrusion 90 extending from the first side block lower surface 46 of the lowermost course of the first side wall 12 and the mortaring in of the second side block female indentation 94 within the lower surface 56 of the second side block 52 of the lowermost course of the second side wall 18.

Referring to FIG. 1, the first side wall 12 of the fireplace 10 has a first wall inner surface 130 facing the interior of the firebox region 29 and the second side wall 18 has a second wall inner surface 132, opposed to and facing the first wall inner surface 130, that also faces the interior of the firebox region 29. To increase the energy and heating efficiency of the fireplace, the first wall inner surface 130 preferably widens and extends into the interior of the firebox region 29, relative to the longitudinal axis B of the first side wall 12, and the second inner surface 132 preferably widens and extends into the interior of the firebox region 29, relative to the longitudinal axis C of the second side wall 18, when a portion of the first and second wall inner surfaces 130, 132 that are proximate the proximal ends 48, 58 of the first and second side blocks 42, 52 forming the first and second side walls 12, 18 is compared to the portions of the first and second wall inner surfaces 130, 132 that are near the distal ends 49, 59 of the first and second side blocks 42, 52 forming the first and second side walls 12, 18 As one skilled in the art will observe, and as shown in FIGS. 1 and 4A–4B, since the first and second wall inner surfaces 130, 132 are formed from a modular block inner surface 134 extending from the proximal end 36 to the distal end 38 of the same modular block 30 that is used in both the first and second side walls 12, 18, the first and second wall inner surfaces 130, 132 will be substantial mirror-images of each other. Because of the widening of the first and second wall inner surfaces 130, 132 as they approach the back wall 24 of the fireplace 10, the cross-sectional area of the fireplace region 29 decreases when comparing the portion of the first and second side walls 12, 18 proximate the first and second side block proximal ends 48, 58 to the portion of the first and second side walls 12, 18 near the first and second side block distal ends 49, 59. The first and second wall inner surfaces 130, 132 act to reflect and radiate heat into the room adjacent the fireplace 10. If the first and second wall inner surfaces 130, 132 were not angled, radiant heat would be trapped in the resulting 90-degree corners of the interior of the firebox 10 and the efficiency of the fireplace 10 would be reduced.

In a further effort to increase the heating efficiency and drawing efficiency of the fireplace 10 construction of the first embodiment, the back wall 24 also has a shaped back wall inner surface 140. As best shown in FIG. 1, the back wall inner surface 140 widens and extends into the interior of the firebox region 29, relative to the longitudinal axis D of the back wall 24, when a portion of the back wall inner surface 140 intermediate the back wall top surface 20 and the back wall bottom surface 22 is compared to the portion of the back wall inner surface 140 proximate the back wall top surface 20. The inclined surface that is defined when the back wall inner surface 140 extends into the interior of the firebox region 29 is a reflecting surface 144 that, like the first and second wall inner surfaces 130, 132, serves to reflect and radiate heat into the adjoining room, while also serving to channel and accelerate the smoke and other products of combustion.

As the back wall 24 is formed from the contiguous joining of the first corner block 60, the second corner block 70, and at least one spacer block 80, or, preferably a plurality of spacer blocks 81, therebetween, it will be apparent to one skilled in the art that the first and second corner blocks 60, 70 and each spacer block 80 has a surface facing the interior of the fireplace region 29 that allows for the formation of the back wall reflecting surface 144. The first corner block reflecting surface 148, the second corner block reflecting surface 150, and the spacer block reflecting surface 152 are shown in FIGS. 1, 5–7, and form the back wall reflecting surface 144.

Referring back to FIG. 1, the fireplace preferably also includes a smoke lip 160 spanning the opening of the firebox region 29 in order to aid in containing smoke and combustion by-products within the firebox region 29 as well as to provide structural support for a portion of a smoke chamber 200 that is disposed onto the firebox region 29. The smoke lip 160 has a smoke lip first end 162, an opposed smoke lip second end 164, a smoke lip inner surface 166, and a smoke lip outer surface 168. The inner surface of the smoke lip first end 162 is disposed onto the proximal end 48 of the uppermost first side block 42 that forms the top course of the first side wall 12 and the inner surface of the smoke lip second end 164 is disposed onto the proximal end 58 of the uppermost second side block 52 that forms the top course of the second side wall 18. When fixed onto the uppermost course of the first and second side walls 12, 18 in this manner, the smoke lip 160 spans the interior of the open-faced firebox region 29 from the first side wall top surface 14 to the second side wall top surface 20 and, in conjunction with the first side wall 12, the second side wall 18, and the back wall 24, defines a firebox exhaust opening 170 in fluid communication with the interior firebox region 29.

The smoke lip 160 is preferable made from a piece of "L" shaped, in cross-section, angled steel. This shape allows the inner surface 166 of the smoke lip 160 to be structurally supported by the upper surfaces 44, 54 of the first and second side blocks 42, 52 on which the smoke lip 160 is disposed, while also allowing a portion of the inner surface 166 of the smoke lip 160 to face downward and inward toward the interior firebox region 29 to help contain smoke and combustion products within the firebox region 29 and the exhaust opening 170. A 3"×2"×⅜" piece of angled steel is the preferred size of the smoke lip 160. As shown in FIG. 1, the smoke lip 160 is preferably fitted flush within the uppermost course of first and second side blocks 42, 52 forming the first and second side walls 12, 18. In order to achieve this preferred flush fit, the first and second side block upper surfaces 44, 54 and the first and second proximal ends 48, 58 of the first and second side blocks 42, 52 that receive the smoke lip 160 are preferably notched in the field.

Referring now to FIGS. 2 and 8–10, a smoke chamber throat 180 is preferably disposed onto the first side wall top surface 14 of the first side wall 12, the second side wall top surface 20 of the second side wall 18, the back wall top surface 26 of the back wall 24 and the smoke lip outer surface 168 of the smoke lip 160. The smoke chamber throat 180 substantially covers the firebox exhaust opening 170 to further enhance the drawing efficiency of the fireplace construction. The smoke chamber throat 180 acts to accelerate the flow of the combustion products out of the firebox region 29 and the exhaust opening 170. The current of room air that is drawn under the smoke lip 160 and into the smoke chamber 200 through the smoke chamber throat 180 is made to gradually bend its course upwards, by which means the air current unites with the ascending current of smoke and combustion products from the firebox region 29. The smoke and combustion products will be less likely to be checked or to be forced back into the room as the air current being drawn into the smoke chamber throat 180 and thence into the smoke chamber 200 acts as an air dam to keep the smoke trapped behind the air dam as the air current and the smoke current go up and through the smoke chamber throat 180.

The smoke chamber throat 180 has a smoke chamber throat top surface 182 and an opposed smoke chamber throat bottom surface 184 with a throat opening 186, in fluid communication with the firebox exhaust opening 170, extending therethrough between the smoke chamber throat top surface 182 to the smoke chamber throat bottom surface 184. The throat opening 186 has a first side throat surface 190 that faces and opposes a second side throat surface 192, and a front side throat surface 194 that faces and opposes a back side throat surface 196. The first side throat surface 190 is joined at its ends to one end of the front side throat surface 194 and one end of the back side throat surface 196, and the second side throat surface 192 is joined at its ends to the opposite end of the front side throat surface 194 and the opposite end of back side throat surface 196 to form a generally rectangular smoke chamber throat 180. The smoke chamber throat 180 may be replaced by a conventional damper (not shown) with a resulting marginal loss in drawing efficiency, or the conventional damper may be disposed onto the smoke chamber throat top surface 182 in fluid communication with the throat opening 186 (not shown).

Figure 9:
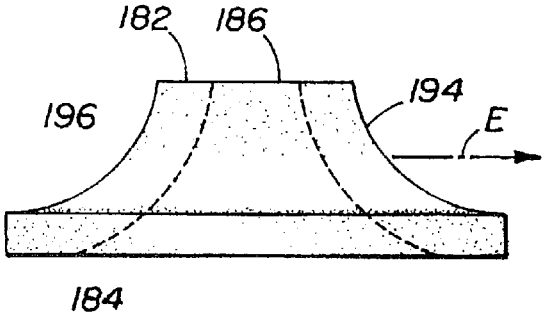
FIG. 9 is a cross-sectional view of a smoke chamber throat through the longitudinal axis E.

Referring to FIG. 9, when the smoke chamber throat 180 is viewed in cross-section through the longitudinal axis E, the front side throat surface 194 and the back side throat surface 196 preferably have a shape wherein the cross-sectional area of the throat opening 186 decreases when comparing the cross-sectional area of the throat opening 186 proximate the smoke throat bottom surface 184 to the cross-sectional area of the throat opening 186 proximate the smoke chamber throat top surface 182. This shape acts as a venturi and aids in accelerating smoke through the smoke chamber throat 180.

Figure 10:
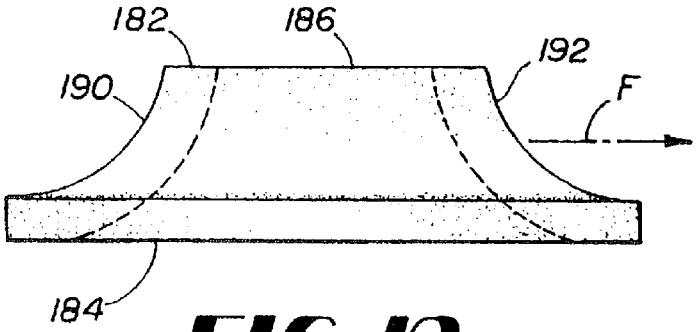
FIG. 10 is a cross-sectional view of the smoke chamber throat through the longitudinal axis F.

The efficiency of the throat 180 may be further increased by also shaping the first side throat surface 190 and the second side throat surface 192 of the smoke chamber throat 180. Thus, preferably, when the smoke chamber throat 180 is viewed in cross-section through the longitudinal axis F, as shown in FIG. 10, the first side throat surface 190 and the second side throat surface 192 have a shape such that the cross-sectional area of the throat opening 186 decreases when comparing the cross-sectional area of the throat opening 186 proximate the smoke throat bottom surface 184 to the cross-sectional area of the throat opening 186 proximate the smoke chamber throat top surface 182. Once again, this shape acts as a venturi and, in conjunction with the venturi shape of the smoke chamber throat 180 when viewed through the longitudinal axis E, increases the drawing efficiency of the fireplace 10. Alternatively, the first and second side throat surfaces 190, 192 may be substantially vertical.

The width of the smoke chamber throat opening 186 at the smoke chamber throat top surface 182 between the smoke chamber throat front side throat surface 194 and the smoke chamber throat back side throat surface 196 may be 3 to 5 inches, and preferably is 4 inches. The height of the smoke chamber throat 180 extending from the smoke chamber throat bottom surface 184 to the smoke chamber throat top surface 182 is sized to ensure that the smoke chamber throat top surface 182 is approximately 6 to 8 inches above the smoke lip outer surface 168 when the smoke chamber throat 180 is properly positioned. These height and width dimensions of the smoke chamber throat 180 aid in increasing the drawing efficiency of the smoke chamber throat 180 and the fireplace 10.

Figure 2:
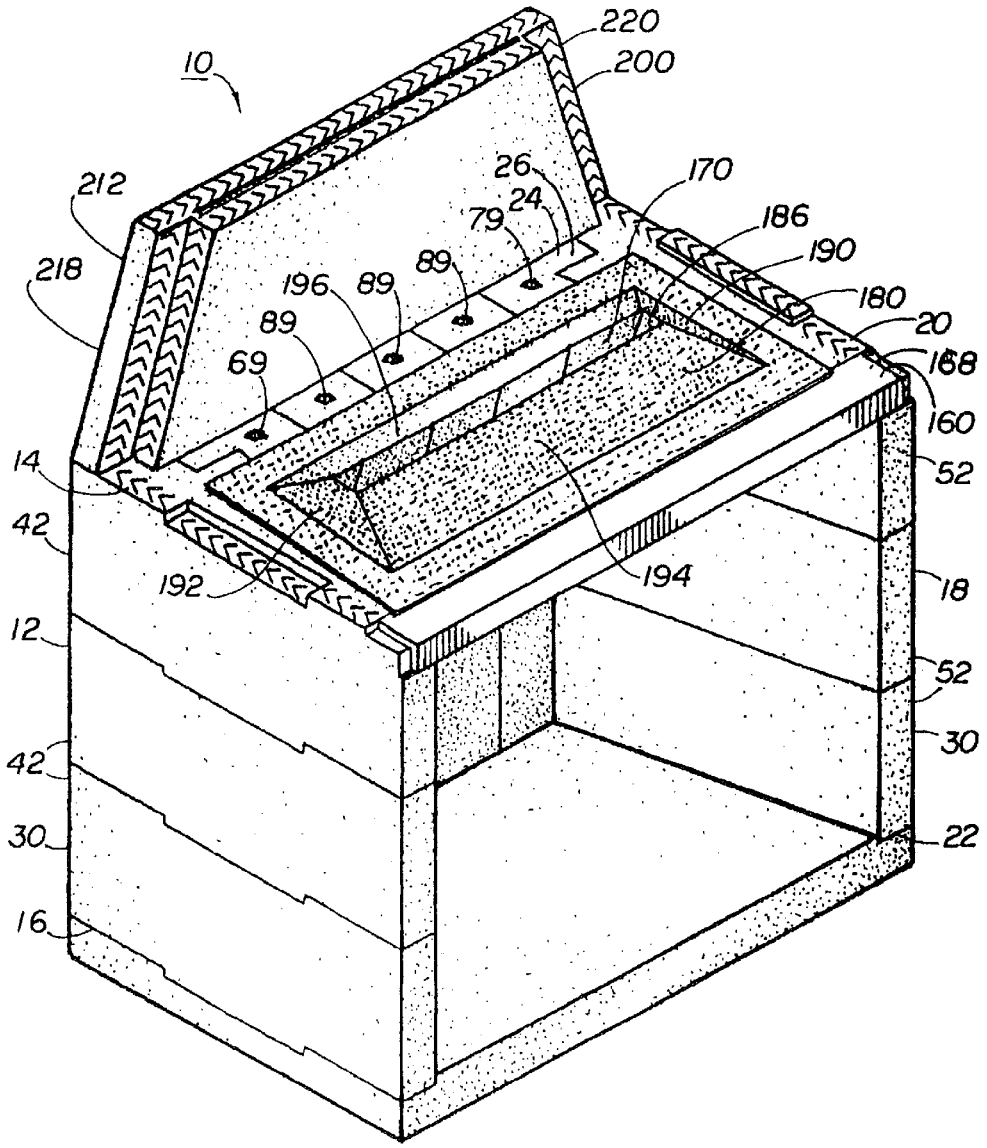
FIG. 2 is a perspective view of the present invention showing a smoke chamber throat disposed onto the fire box exhaust opening of the firebox and a vertical load bearing section of a smoke chamber disposed onto the upper surface of the back wall of the fireplace.
Figure 3:
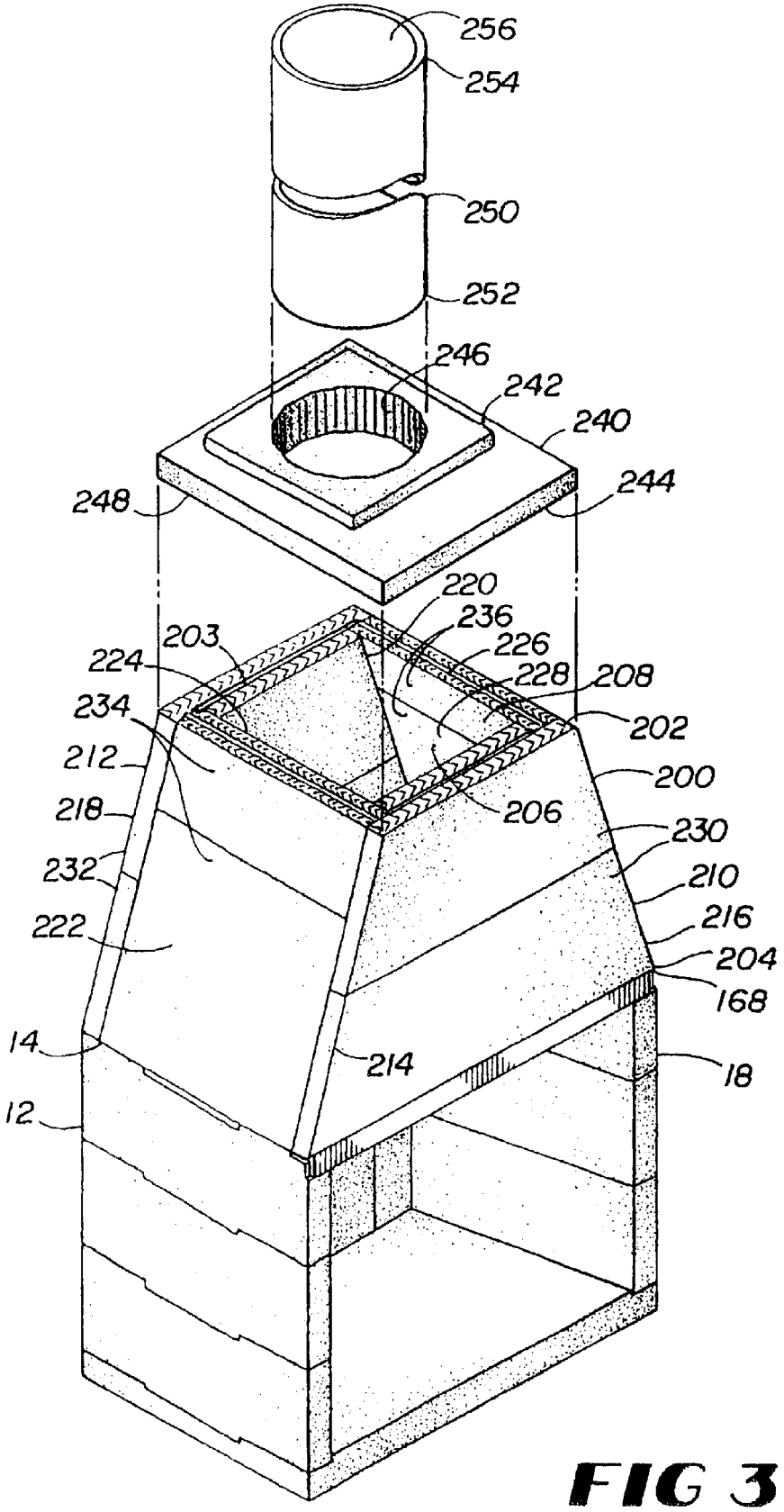
FIG. 3 is an exploded perspective view of the present invention showing a top plate disposed onto the smoke chamber of the fireplace.

As shown in FIGS. 2 and 3, a smoke chamber 200 is preferably provided to funnel the products of combustion to a chimney 250. The smoke chamber 200 of the present invention has a smoke chamber top surface 202 and a smoke chamber bottom surface 204 which is disposed onto the first side wall top surface 14, the second side wall top surface 20, the smoke lip outer surface 168, and the back wall top surface 26. The smoke chamber defines an interior smoke chamber region 206 void which is in fluid communication with a smoke chamber exhaust opening 208 that is defined by the smoke chamber top surface 202 and with the firebox exhaust opening 170. Alternatively, if the smoke chamber throat 180 is used, the interior smoke chamber region 206 void is in fluid communication with the smoke chamber exhaust opening 208 and the throat opening 186 of the smoke chamber throat 180. The interior smoke chamber 206 void may also be in fluid communication with an opening in a conventional smoke damper (not shown) is the conventional smoke damper is disposed on either the firebox exhaust opening 170 or the smoke chamber throat opening 186. As one skilled in the art will appreciate, the smoke chamber acts to funnel the products of combustion emanating from the firebox exhaust opening 170 upwards toward the smoke chamber exhaust opening 208.

As shown in FIG. 2, the first and second corner block air chambers 69, 79 and the plurality of spacer block air chambers 89 are also in fluid communication with the interior smoke chamber region 206 void. By allowing the air chambers 69, 79, 89 to open directly into the void 206 of the smoke chamber 200, the drafting efficiency of the fireplace 10 is increased by replacing the relatively cooler air in the smoke chamber 200 with higher efficiency high temperature air. The air chambers 69, 79, 89 provide a quantity of high temperature air directly into the smoke chamber 200, where it immediately rises into and through the fireplace chimney 250 which increases both the flow rate and the volume of air and smoke drawn from the firebox region 29. Since the preferred design of the air chambers 69, 79, 89 is not open to the outside of the fireplace, only the relatively cool air from the interior void 206 of the smoke chamber 200 is drawn down into the air chambers 69, 79, 89 to replace the high temperature air rising from the interiors of the air chambers 69, 79, 89. The rising column of heated air within the smoke chamber 200 also increases the efficiency of the air dam formed from the cooler room temperature air entering the fireplace 10 through the open front of the fireplace 10. The marked differential in temperature helps to prevent the escape of smoke from the firebox region 29 and the smoke chamber 200. As one skilled in the art will appreciate, the actual number of air chambers 69, 79, 89 of the fireplace 10 and the specific size of each air chamber is a function of the size of the fireplace. As the relative width of the fireplace 10 of the present invention increases, the number of spacer block air chambers 89 correspondingly increases as more spacer blocks 80 are utilized in the construction of the back wall 24 of the fireplace 10.

The smoke chamber 200 has a first load bearing section 210, having a first proximal edge 214 and a first distal edge 216, and an opposed second load bearing section 212 having a second proximal edge 218 and a second distal edge 220. The first and second load bearing sections 210, 212 are substantially vertical. The smoke chamber 200 also has a first inclined section 222 having a first interior surface 224, and an opposed second inclined section 226 having a second interior surface 228. The first interior surface 224 of the first inclined section 222 is sized to complementarily engage the first proximal edge 214 of the first load bearing section 210 and the second proximal edge 218 of the second load bearing section 220, and the second interior surface 228 is sized to complementarily engage the first distal edge 216 of the first load bearing section 210 and the second distal edge 220 of the second load bearing section 212. The smoke chamber 200 is formed and the smoke chamber interior region 206 void is defined, when the first load bearing section 210, the second load bearing section 212, the first inclined section 222, and the second inclined section 226 are contiguously engaged.

As shown in FIG. 3, the first load bearing section 210 may be composed of a plurality of first load bearing members 230 that are engaged edge-to-edge. Similarly, the second load bearing section 212 may be composed of a plurality of second load bearing members 232 engaged edge-to-edge. The first and second inclined sections 222, 226 may also be composed of a plurality of first and second inclined members 234, 236 that are engaged edge to edge. In order to provide a physical obstruction to the passage of smoke and combustion products, the edge-to-edge joint of the first and second load bearing members 230, 232, and the first and second inclined members 234, 236, is preferably a mortise and tendon joint extending substantially the length of the respective edge-to-edge joints.

Referring to FIG. 3, the fireplace 10 of the first embodiment of the present invention also preferably has a fireplace top plate 240 disposed onto the smoke chamber top surface 202. The top plate 240 has a top plate upper surface 242, a top plate lower surface 244, that is opposed to the top plate upper surface 242, and a top plate bore 246 extending therethrough the top plate 240 between the top plate upper surface 242 and the top plate lower surface 244. The top plate bore 246 is in fluid communication with the smoke chamber exhaust opening 208. To facilitate the simplicity of construction and to provide a substantially leak-proof seal, the smoke chamber top surface 208 of the smoke chamber 200 has a smoke chamber male protrusion 203 extending therefrom that is sized to complementarily engage a top plate female indentation 248 within the top plate lower surface 244.

The fireplace construction of the first embodiment of the present invention is substantially complete when a chimney 250 is fixed to the top plate upper surface 242 of the top plate 240. As shown in FIG. 3, the chimney 250 has a first chimney end 252 and a second chimney end 254 that defines a chimney passage 256 extending therethrough the chimney between the first chimney end 252 and the second chimney end 254. The first chimney end 252 is disposed onto the top plate upper surface 242 of the top plate 240 so that the chimney passage 256 is in fluid communication with the top plate bore 246. The chimney 250 may be a conventional brick and mortar construction with a flue liner, a metal construction, or a construction of precast modular chimney blocks made of the same material as the fireplace.

Figure 11:
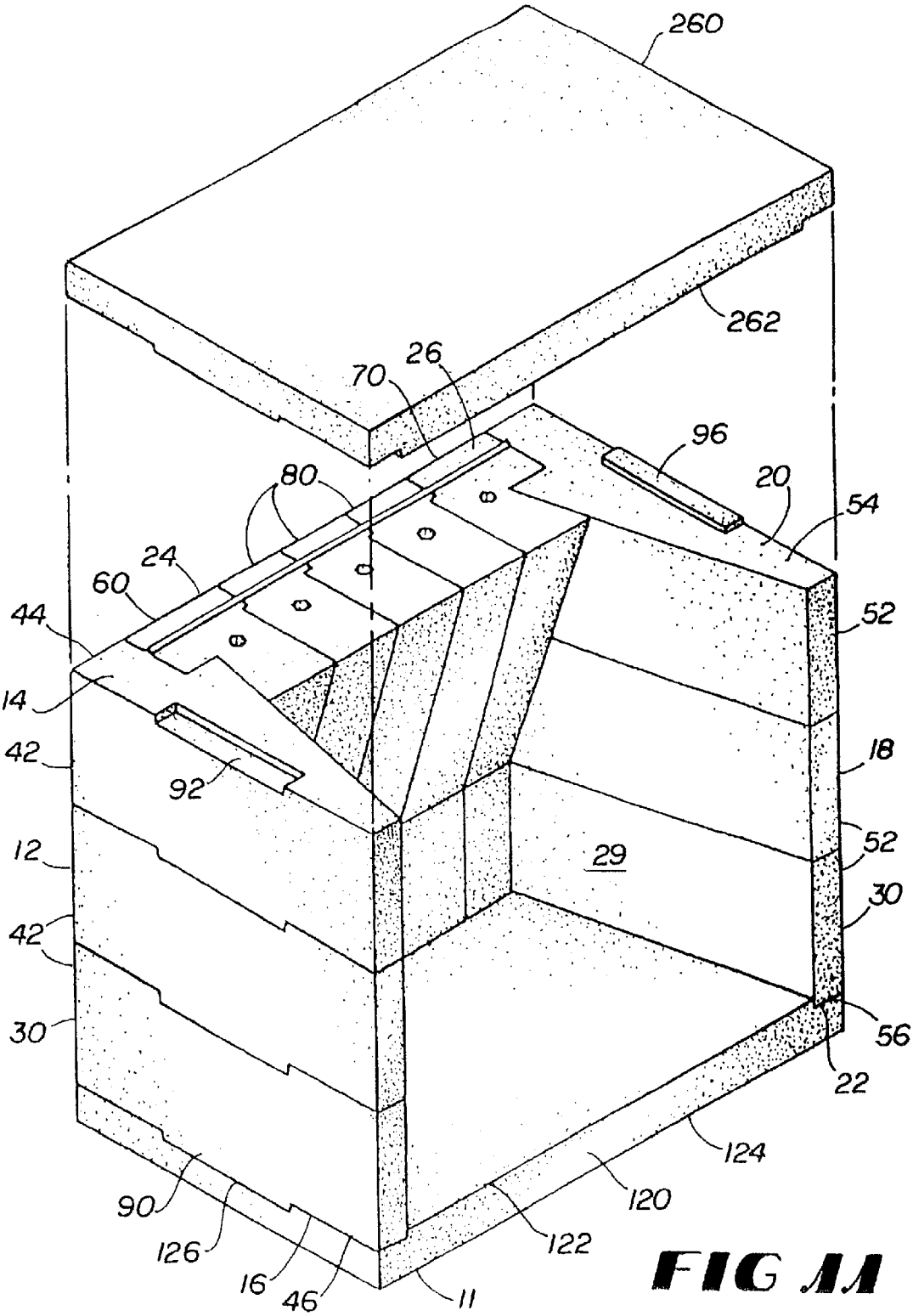
FIG. 11 is a perspective view of a second embodiment of the present invention showing a fire box top disposed onto the upper surfaces of the first side wall, the second side wall and the back wall.

FIG. 11 shows a second embodiment of a modular fireplace of the present invention. The construction of the second embodiment of is similar to the first embodiment and, accordingly, the figures use the same reference numbers for similar components. The components in FIG. 11 that use the same reference numerals as in FIGS. 1, 2, and 4A–6 are substantially equivalent and, therefore, the description thereof is omitted for the second embodiment.

As shown in FIG. 11, the second embodiment of the present invention encompasses a modular fireplace 11 having a firebox top 260. The firebox top 260 has a firebox top lower surface 262 that is disposed onto the first side wall top surface, the second side wall top surface 20, and the back wall top surface 26 so that the interior firebox region 29 is enclosed. This results in a vent-free modular fireplace construction. The first side wall 12, the second side wall 18, the back wall 24, and the base 120, if used, are assembled from the same modular blocks described in the first embodiment and, therefore, the description thereof is omitted for this embodiment. The second embodiment of the present invention is intended for use with any fireplace application, such as a gas line fireplace, that does not require the use of an exhaust vent. Since the fireplace may be drilled through with an ordinary masonry drill bit, a natural gas connection may be readily supplied to the interior of the firebox region 29.

Figure 12:
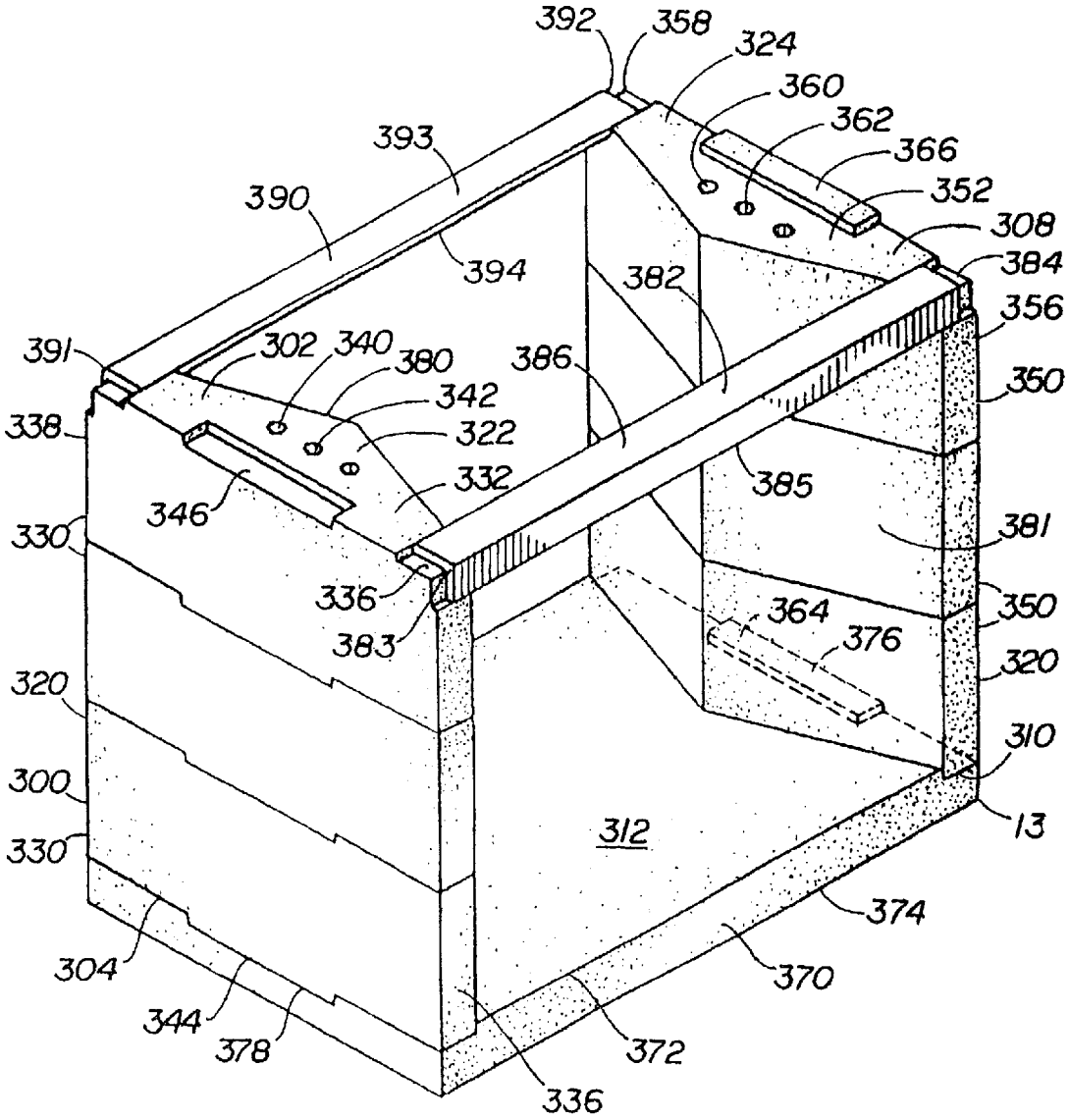
FIG. 12 is a perspective view of a third embodiment of the present invention showing a first side wall of a first stacked plurality of modular side blocks, a second side wall of a second stacked plurality of modular side blocks, a first smoke lip, and a second smoke lip, defining an interior firebox region with a firebox exhaust opening and showing a plurality of first air chambers and a plurality of second air chambers.

FIG. 12 shows a third embodiment of the present invention that allows an outside observer to see through the firebox region 312. This embodiment allows the fire within the firebox 312 of the see-through modular fireplace 13 to be viewed from two separate rooms. The construction of the third embodiment of the fireplace 13 is similar to the first embodiment and, accordingly, the figures use the same reference numbers for similar components. The smoke chamber throat 180, if used, the smoke chamber 200, the fireplace top plate 240, and the chimney 250 of the third embodiment of the present invention are substantially equivalent and, therefore, the description thereof is omitted for the third embodiment.

The third embodiment of the present invention has a first side wall 300 having a first side wall top surface 302, a first side wall bottom surface 304, and a first side wall inner surface 380. The third embodiment also has a second side wall 306 having a second side wall top surface 308, a second side wall bottom surface 310, and a second side wall inner surface 381. The first side wall inner surface 380 faces and is spaced apart from the second side wall inner surface 381 so that the first side wall 300 and the second side wall 306 are opposed. The first side wall 300 and the opposing second side wall 306 define an interior firebox region 312 that is open-faced on two sides.

The first side wall 300 is formed of a plurality of sequentially stacked modular first side blocks 330. The second side wall 306, like the first side wall 300, is formed of a plurality of sequentially stacked modular second side blocks 350. As best shown in FIGS. 12 and 13A–13B, the modular side block 320 that is used in the first and second side walls 300, 306 has a side block upper surface 322, an opposed side block lower surface 324, a side block proximal end 326, and an opposed side block distal end 328. The upper surface 322 of the side block 320 is of a size to be complementarily engaged by at least a portion of the side block lower surface 324 of one adjacent side block 320 so that the upper side block surface 322 and the lower side block surface 324 forms a substantially fire and smoke leak-proof seal therebetween when the side blocks 320 are sequentially stacked and mortared together.

For clarity, the modular side blocks 320 that form the first and second side walls 300, 306 will be described as a first side block 330 and a second side block 350, but, as one skilled in the art will appreciate, the modular side block 320 that is utilized in the first side wall 300 is the same modular side block 320 that is used in the second side wall 306. The modular side block 320 is merely rotated 180 degrees around a longitudinal axis G, extending through the side block 320 from the side block proximal end 326 to the side block distal end 328, so that the modular block upper surface 322 of the modular side block 320 used to form the first side wall 300 becomes the modular block lower surface 324 of the modular side block 320 used to form the second side wall 306.

Referring back to FIGS. 12 and 13A, each first side block 330 forming the first side wall 300 has a first side block upper surface 332, an opposed first side block lower surface 334, a first side block proximal end 336, and an opposed first side block distal end 338. Preferably, the first side block upper surface 332 and the first side block lower surface 334 are substantially planer and parallel to each other. Each first side block 330 further has at least one first block bore 340 extending through the first side block 330 between the first side block upper surface 332 to the first side block lower surface 334. Preferably, each first side block 330 has a plurality of first block bores 340 extending through the first side block 330 between the first side block upper surface 332 to the first side block lower surface 334.

The first side upper surface 332 of the first side block 330 is sized to complementarily engage the first side block lower surface 334 of one adjacent first side block 330 so that when the first side blocks 330 are sequentially stacked, the first block bore 340, or bores 340, of each first side block 330 substantially co-axially aligns with the first block bore 340, or bores 340, of the other first side blocks 330 in the first side wall 300 to define at least one first side block air chamber 342, or, preferably, a plurality of first side block air chambers 342.

Similarly, referring to FIGS. 12 and 13B, each second side block 350 forming the second side wall 306 has a second side block upper surface 352, an opposed second side block lower surface 354, a second side block proximal end 356, and an opposed second side block distal end 358. Preferably, the second side block upper surface 352 and the second side block lower surface 354 are substantially planer and parallel to each other. Each second side block 350 further has at least one second block bores 360 extending through the second side block 350 between the second side block upper surface 352 and the second side block lower surface 354. Preferably, each second side block 350 has a plurality of second block bores 360 extending through the second side block 350 between the second side block upper surface 352 and the second side block lower surface 354.

The second side upper surface 352 of the second side block 350 is sized to complementarily engage the second side block lower surface 354 of one adjacent second side block 350 so that when the second side blocks 350 are sequentially stacked, the second block bore 360, or bores 360, of each second side block 350 substantially co-axially aligns with the second block bore 360, or bores 360, of the other second side blocks 350 in the second side wall 306 to define at least one second side block air chamber 362, or, preferably, a plurality of second side block air chambers 362.

The first side wall top surface 302 is formed by the first side block upper surface 332 of the uppermost course of the first side block 330 of the first side wall 300 and the first side wall bottom surface 304 is formed by the first side block lower surface 334 of the lowermost course of the first side block 330 of the first side wall 300. The second side wall top surface 308 is formed by the second side block upper surface 352 of the uppermost course of the second side block 350 of the second side wall 306 and the second side wall bottom surface 310 is formed by the second side block lower surface 354 of the lowermost course of the second side block 350 of the second side wall 306. The upper surfaces 332, 352 of the first and second side blocks 330, 350 are of a size to be complementarily engaged by at least a portion of the lower surfaces 334, 354 of one adjacent first or second side block 330, 350, respectively, to form a substantially fire and smoke leak-proof seal therebetween when the first side blocks 330 or the second side blocks 330 are sequentially stacked and mortared together.

As shown in FIGS. 12 and 13A, to aid in the placement and stacking of the first side blocks 330 and to aid in forming a substantially leak-proof seal, the first side block upper surface 332 of each first side block 330 includes a first side block upper surface female indentation 346 therein, and the first side block lower surface 334 of each first side block 330 includes a first side block lower surface male protrusion 344 extending therefrom. The first side block lower surface male protrusion 344 is sized to complementarily engage one first side block upper surface female indentation 346 so that the first side blocks 330 may be sequentially stacked.

Similarly, as shown in FIGS. 12 and 13B, and as one skilled in the art will anticipate upon noting that the first side block 330 and the second side block 350 are the same modular side block 320 with the second side block 350 merely rotated 180-degrees around the longitudinal axis G of the modular side block 320 from the relative position of the first side block 330, the second side block lower surface 354 of each second side block 350 includes a second side block lower surface female indentation 364 therein and the second side block upper surface 352 of each second side block includes a second side block upper surface male protrusion 366 extending therefrom. The second side block lower surface female indentation 364 is sized to complementarily engage one second side block lower surface block male protrusion 366 so that the second side blocks 350 can be sequentially stacked. The male block protrusions 344, 366 and the female block indentations 346, 364 of the first and second side blocks 330, 350 provide a physical barrier to the passage of smoke or flame through the mortared joints of the respective courses of the first and second blocks 330, 350 forming the first and second side walls 300, 306.

The fireplace 13 is preferably erected on a noncombustible base with a noncombustible hearth extension in front of the firebox region. The noncombustible base may be a concrete slab or it may preferably be a base plate 370. As best shown in FIG. 12, the base plate 370 has a base plate upper surface 372 and an opposed base plate lower surface 374. The base plate upper surface 372 is sized to complementarily engage the first side wall bottom surface 304 and the second side wall bottom surface 310. In order to provide ease of assembly and a secure foundation, the base plate upper surface 372 preferably has a base plate female indentation 378 that accepts the first side block male protrusion 344 extending from the first side block lower surface 334 of the lowermost course of the first side block 330 forming the first side wall 300. The base plate upper surface also preferably has a base plate male extension 376 that is accepted within the second side block female indentation 364 of the second side block lower surface 354 of lowermost course of the second side block 330 forming the second side wall 306.

If the base plate 370 is not used, the fireplace may be disposed onto a prepared concrete slab by using a two-step field modification. First, the first side block male protrusion 344 extending from the first side block lower surface 334 of the lowermost course of the first side block 330 forming the first side wall 300 is sawed off. Second, the second side block female indentation 364 within the second side block lower surface 354 of the lowermost course of the second side block 330 forming the second side wall 306 is mortared in.

Referring to FIG. 12, the first side wall 300 of the fireplace 13 has a first wall inner surface 380 facing the interior of the firebox region 312 and the second side wall 306 has a second wall inner surface 381, opposed to the first wall inner surface 380, that also faces the interior of the firebox region 312. To increase the energy and heating efficiency of the fireplace, the first wall inner surface 380 preferably widens and extends inwardly into the interior of the fire box region 312, relative to the longitudinal axis H of the first side wall 300, until the midpoint of the first side wall is reached. Substantially at the midpoint of the first side wall 300, the first wall inner surface 380 begins to narrow and extend outwardly from the interior of the fire box region 312, relative to the longitudinal axis H of the first side wall 300, until reaching the end of the first side wall 300 where the relative width of the first wall inner surface 380 is substantially the same as the starting width 380 of the first wall inner surface 300. As one skilled in the art will appreciate, the second side wall 306 of the fireplace 13 has a second wall inner surface 381 that is substantially a mirror image of the first wall inner surface 380 since the same modular side block 320 is used (rotated 180 degrees around the longitudinal axis G of the modular side block 320) in the construction of the fireplace 13. The design of the first and second wall inner surfaces 380, 381 acts to reflect and radiate heat into the rooms that adjoin the open-faces of the fireplace 13.

Still referring to FIG. 12, the third embodiment of the present invention also includes a pair of smoke lips 382, 390 spanning the open-faces of the firebox region 312 of the fireplace 13. These smoke lips 382, 390 help to contain the smoke and combustion by-products within the firebox region 312 as well as providing structural support for a portion of the smoke chamber 200 that is disposed onto the firebox region 312.

The first smoke lip 382 has a first smoke lip proximal end 383, an opposed first smoke lip distal end 384, a first smoke lip inner surface 385 and a first smoke lip outer surface 386. The first smoke lip inner surface 385 of the first smoke lip proximal end 383 is disposed onto the proximal end 336 of the uppermost course of the first modular side block 330 of the first side wall 300 and the inner surface 385 of the first smoke lip distal end 384 is disposed onto the proximal end 356 of the uppermost course of the second modular side block 350 of the second side wall 306.

Similarly, the second smoke lip 390 has a second smoke lip proximal end 391, an opposed second smoke lip distal end 392, a second smoke lip inner surface 393 and a second smoke lip outer surface 394. The second smoke lip inner surface 393 of the second smoke lip proximal end 391 is disposed onto the distal end 338 of the uppermost course of the first modular side block 330 of the first side wall 300 and the second smoke lip inner surface 393 of the second smoke lip distal end 392 is disposed onto the distal end 358 of the uppermost course of the second modular side block 350 of the second side wall 306. When fixed to the uppermost course of the first and second side walls 300, 306 in this manner, the first and second smoke lips 382, 390 span the interior of the open-faces of the firebox region 312 and, in conjunction with the first and second side walls 300, 306, define a firebox exhaust opening 395.

The smoke lips 382, 390 are preferable made from a piece of "L" shaped, in cross-section, angled steel. This shape allows the inner surface of the smoke lip 385, 393 to be structurally supported by the upper surface 332, 352 of the first and second side blocks 330, 350 on which the smoke lip 382, 390 is disposed while also allowing a portion of the inner surface 385, 393 to face downward and inward toward the interior of the firebox region 312 to help contain smoke and combustion products within the firebox region 312 and the exhaust opening 395. Pieces of 3"×2"×⅜" angled steel is the preferred size of the smoke lips 382, 390.

As shown in FIG. 11, the smoke lips 382, 390 are preferably fitted flush within the uppermost course of the first and second side blocks 330, 350 forming the first and second side walls 300, 306. In order to achieve this preferred flush fit, the first and second side block upper surfaces 332, 352 and the first and second proximal ends 336, 356 and distal ends 338, 358 of the first and second side blocks 330, 350 that receive the smoke lips 382, 390 are preferably notched in the field.

Figure 8:
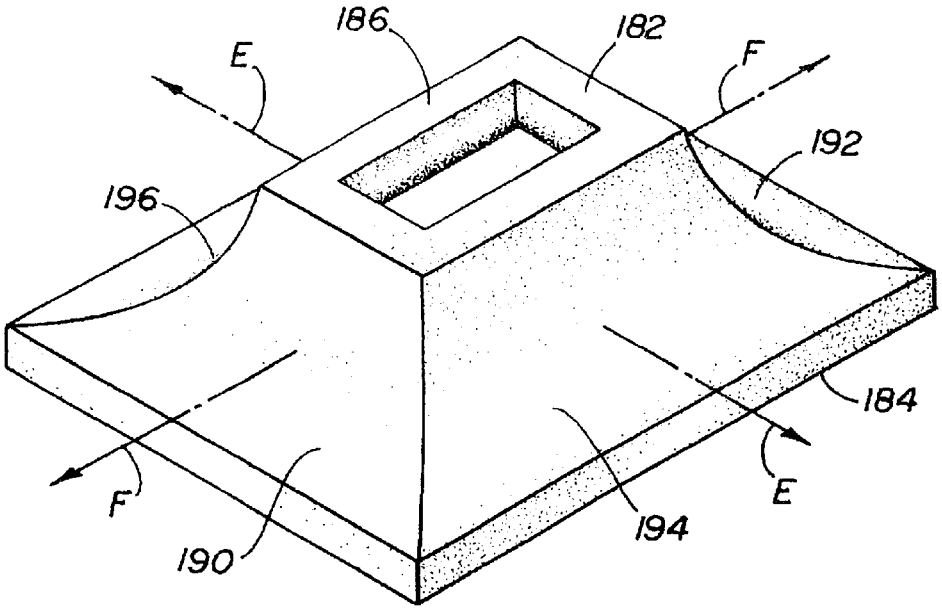
FIG. 8 is a perspective view of a smoke chamber throat showing the longitudinal axis E and F.

Referring now to FIGS. 8–10, a smoke chamber throat 180 is preferably disposed onto the first side wall top surface 308 of the first side wall 300, the second side wall top surface 308 of the second side wall 306, and the first and second smoke lip outer surfaces 386, 394 of the first and second smoke lips 382, 390, and covers the firebox exhaust opening 395 to further enhance the drawing efficiency of the fireplace construction.

Referring to FIGS. 3 and 12, the smoke chamber bottom surface 204 is disposed onto the first side wall top surface 302, the second side wall top surface 308, and the first and second smoke lip outer surfaces 386, 394. The smoke chamber 200, the top plate 240, and the chimney 250 used in the third embodiment is substantially equivalent to the first embodiment of the present invention and the description is therefore omitted.

As one skilled in the art will appreciate, the first and second plurality of air chambers 342, 362 are also in fluid communication with the interior smoke chamber region 206 void of the smoke chamber 200. As noted in the discussion of the first embodiment, by allowing the air chambers 342, 362 to be open directly into the interior region 206 void of the smoke chamber 200, the drafting efficiency of the fireplace 13 is increased by replacing the relatively cooler air in the smoke chamber 200 with higher efficiency high temperature air. The air chambers 342, 362 provide a quantity of high temperature air directly into the smoke chamber 200, where it immediately rises into and through the fireplace chimney 250 which increases both the flow rate and the volume of air and smoke drawn from the firebox 312. Since the preferred design of the air chambers 342, 362 is not open to the outside of the fireplace 13, only the relatively cool air from the interior region 206 void of the smoke chamber is drawn down into the air chambers 342, 362 to replace the high temperature air rising from the interiors of the air chambers 342, 362.

The fourth embodiment of the modular fireplace of the present invention is shown in FIG. 14. The construction of the fourth embodiment of the fireplace is similar to the third embodiment and, accordingly, the figures use the same reference numbers for similar components. The base plate 370, if used, the smoke lips 382, 390, if used, and the first and second walls 300, 306 of the fourth embodiment of the present invention are substantially equivalent and, therefore, the description thereof is omitted for the fourth embodiment. Furthermore, the components in FIG. 13 that use the same reference numerals as in FIGS. 12 and 13 are substantially equivalent and the description thereof is omitted for the fourth embodiment.

As shown in FIG. 14, the fourth embodiment of the present invention encompasses a modular fireplace 15 having a see-through firebox region 312 that has a firebox top 400 having a firebox lower surface 402 that is disposed onto the first side wall top surface 302, the second side wall top surface 308, and, optionally, the first and second smoke lip outer surfaces 386, 394 of the first and second smoke lips 382, 390. The addition of the firebox top 400 encloses the interior firebox region 312 so that a vent-free modular fireplace 15 is constructed. The fourth embodiment of the present invention is intended for use with any fireplace application, such as a gas line fireplace, that does not require the use of an exhaust vent and, since the fireplace 15 may be drilled through with an ordinary masonry drill bit, a natural gas connection may be readily supplied to the interior of the firebox region 312.

In order to reduce the weight of the modular blocks used in the above described embodiments of the present invention and to thereby reduce the labor expense of the modular fireplace by reducing the number of people required to move and position the blocks forming the fireplace, a lightweight concrete composition is preferably utilized for the modular components of the fireplace 10, 11, 13, 15 of the present invention. Preferably, only the smoke lip 160, 382, 390 and the conventional smoke damper, if used, are not made of the lightweight concrete composition but are made of metal. The chosen concrete composition preferably should withstand the extreme heat-resistance required of the fireplace, yet still provide the structural strength and lack of brittleness required of the precast modular components. Preferably, the concrete mixture of the fireplace 10, 11, 13, 15 is selected to form a waterproof, high strength, hard material that has good insulation properties. To achieve such a desired concrete mixture, crushed pumice, type S mortar and glass fibers are mixed with water. After the mixture is cured, it forms a hard material with superior insulation properties when compared to conventional material compositions using Portland cement. The preferred concrete mixture is a proportional mix of approximately fifteen hundred [1500] lbs. of crushed pumice to approximately thirty [30] gallons of water to approximately three hundred and seventy five [375] lbs. of mortar to approximately one [1] lb. of fibers. As one skilled in the art will appreciate, the modular fireplace 10, 11, 13, 15 of the present invention could be constructed of other refractive materials as long the materials provide high strength without brittleness, extreme heat-resistance, good insulation properties, and resistance to the corrosive effect of the combustion products.

All of the joints of the modular fireplace 10, 11, 13, 15 of the present invention are mortared to aid in providing a substantially smoke and flame leak-proof seal. The mortar used is preferably a wet, sticky, air setting, high temperature mortar that combines the two most desirable characteristics of high temperature bonding mortars: smooth, easy workability, and a strong bond for added life and protection to fire/heat proof joints. The preferred mortar is manufactured by the A. P. Green Refractories Co. under the trade name SAIRMIX-7. It is appropriate to trowel the firebox 29, 312, smoke chamber 200, and top plate joints 240. The joints should be completely covered with 1/16 to 1/8 inch of mortar to secure the joint. The preferred mortar should be used as an adhesive rather than a conventional mortar. After the component block is set into place, the mortar will push and ooze out of the joint and should be removed to ensure a smooth finish. After completion of the fireplace construction, all of the joints should be "buttered." This procedure involves a final smoothing over and sealing of all joints to assure a substantially leak-proof construction.

Although the present invention has been described With reference to specific details of certain embodiments thereof, it is not intended that such details should be regarded as limitations upon the scope of the invention except as and to the extent that they are included in the accompanying text.

What is claimed is:

1. A fireplace comprising:

a first side wall having a first side wall top surface and a first side wall bottom surface, the first side wall formed of a plurality of sequentially stacked modular side blocks, each side block having a first horizontally extending side block surface, an opposed second horizontally extending side block surface, a side block proximal end, and an opposed block distal end, wherein the side block has a sideblock longitudinal length therebetween the side block proximal end and the side block distal end, and wherein the first side block surface of one modular side block is sized to complementarily engage the second side block surface of the adjacent modular side block;

a second side wall having a second side wall top surface and a second side wall bottom surface, the second side wall formed of a sequentially stacked plurality of the modular side blocks, wherein said first side wall is spaced apart from and opposes said second side wall, and wherein said first side wall and said second side wall have a longitudinal length substantially equal to the longitudinal length of the side block;

a back wall having a back wall top surface and a back wall bottom surface, the backwall having a backwall longitudinal length therebetween the backwall top surface and the backwall bottom surface, the back wall formed of an upright first modular corner block, an upright second modular corner block, and at least one upright spacer block, the first modular corner block having a first corner block proximal surface, and an opposed first corner block distal surface, the second modular corner block having a second corner block proximal surface, and an opposed second corner block distal surface, the spacer block having a spacer block proximal surface, and an opposed spacer block distal surface, wherein each of the first corner block, the second corner block, and the spacer block have a longitudinal length substantially equal to the longitudinal length of the backwall, wherein the first corner block distal surface is sized to complementarily engage the spacer block proximal surface of the spacer block and the second corner block proximal surface is sized to complementarily engage the spacer block distal surface of the spacer block so that the first corner block and the second corner block are contiguous with the spacer block, wherein the first corner block proximal surface is sized to complementarily engage the side block distal end of the side blocks of the first side wall and the second corner block distal surface is sized to complementarily engage the side block distal end of the side blocks of the second side wall so that the back wall is contiguous with the first side wall and the second side wall and defines an interior open-faced firebox region having a substantially "U" shape in top plan view.

2. The fireplace of claim 1, wherein the back wall has a plurality of substantially vertical spacer blocks including a first spacer block and a second spacer block, wherein the spacer block proximal surface of one spacer block is sized to complementarily engage the spacer block distal surface of the adjacent spacer block in the plurality of spacer blocks, and wherein the first corner block distal surface is sized to complementarily engage the spacer block proximal surface of the first spacer block and the second corner block proximal surface is sized to complementarily engage the spacer block distal surface of the second spacer block so that the first corner block and the second corner block are contiguous with the plurality of spacer blocks.

3. The fireplace of claim 2, wherein each of the spacer blocks includes a spacer block top end and an opposed spacer block bottom end and each of the spacer blocks defines a spacer block air chamber extending therein from an open upper end on the spacer block top end, to a closed lower end proximate the spacer block bottom end.

4. The fireplace of claim 3, wherein the first corner block includes a first corner block top end and an opposed first corner block bottom end and the first corner block defines a first corner block air chamber therein extending from an open first corner block upper end on the first corner block top end to a closed first corner block lower end proximate the first corner block bottom end, and wherein the second corner block includes a second corner block top end and an opposed second corner block bottom end and the second corner block defines a second corner block air chamber extending therein from an open second corner block upper end on the second corner block top end to a closed second corner block lower end proximate the second corner block bottom end.

5. The fireplace of claim 4, wherein the first corner block air chamber, the second corner block air chamber, and each spacer block air chamber has a cylindrical cross-section.

6. The fireplace of claim 4, further comprising a base having a base upper surface and an opposed base lower surface, the base upper surface sized to complementarily engage the first side wall bottom surface, the second side wall bottom surface and the rear wall bottom surface.

7. The fireplace of claim 4, wherein the first side block surface of each side block includes a female indentation therein and the second side block surface of each side block includes a male protrusion extending therefrom, wherein the male protrusion is sized to complementarily engage one female indentation therein.

8. The fireplace of claim 7, wherein the side block distal end of each side block has a female block indentation therein and the first corner block proximal surface of the first corner block includes a first corner block male protrusion extending therefrom, the first corner block male protrusion sized to complementarily engage the female block indentation of the side blocks forming the first side wall, and wherein the second corner block distal surface of the second corner block includes a second corner block male protrusion extending therefrom, the second corner block male protrusion sized to complementarily engage the female block indentation of the side blocks forming the second side wall.

9. The fireplace of claim 8, wherein the spacer block proximal surface of each spacer block includes a spacer block male protrusion extending therefrom and the spacer block distal surface of each spacer block include a spacer block female indentation therein, wherein the spacer block male protrusion is sized to complementarily engage one spacer block female indentation so that the spacer blocks can be integrally stacked.

10. The fireplace of claim 9, wherein the first corner block distal surface of the first corner block includes a first corner block spacer male protrusion sized to complementarily engage one spacer block female indentation so that the first corner block and one of the spacer blocks can be integrally stacked, and wherein the second corner block proximal surface includes a second corner block female indentation therein sized to complementarily engage one spacer block male protrusion so that the second corner block and one of the spacer blocks can be integrally fitted.

11. The fireplace of claim 1, further comprising a firebox top having a firebox top lower surface disposed on the first side wall top surface, the second side wall top surface, and the back wall top surface so that the interior firebox region is enclosed.

12. The fireplace of claim 4, further comprising a smoke lip having a smoke lip first end, an opposed smoke lip second end, a smoke lip inner surface, and a smoke lip outer surface, the smoke lip inner surface of the smoke lip first end disposed onto the first side block upper surface, proximal the first side block proximal end, of the first side block on top of the first side wall, the smoke lip inner surface of the smoke lip second end disposed onto the second side block upper surface, proximal the second side block proximal end, of the second side block on top of the second side wall, so that the smoke lip spans the interior of the open-faced firebox region from the first side wall top surface to the second side wall top surface, and so that the smoke lip, the first side wall, the second side wall, and the back wall define a firebox exhaust opening.

13. The fireplace of claim 12, wherein the smoke lip is made of an angled steel having a "L" shaped cross-section.

14. The fireplace of claim 12, further comprising a smoke chamber throat having a smoke chamber throat top surface and an opposed smoke chamber throat bottom surface, the smoke chamber throat defining a throat opening extending therethrough between the smoke chamber throat top surface to the smoke chamber throat bottom surface, the smoke chamber throat bottom surface disposed onto the first side wall top surface of the first side wall, the second side wall top surface of the second side wall, the back wall top surface of the back wall and the smoke lip outer surface of the smoke lip, so that the smoke chamber throat covers the firebox exhaust opening and the throat opening is in fluid communication with the firebox exhaust opening.

15. The fireplace of claim 12, further comprising a smoke chamber having a smoke chamber top surface, a smoke chamber bottom surface, the smoke chamber top surface defining a smoke chamber exhaust opening therethrough, the smoke chamber bottom surface disposed onto the first side wall top surface, the second side wall top surface, the smoke lip, and the back wall top surface and defining an interior smoke chamber region in fluid communication with the smoke chamber exhaust opening and the firebox exhaust opening.

16. The fireplace of claim 15, wherein the interior smoke chamber is in fluid communication with the first corner block air chamber, the second corner block air chamber, and each of the spacer block air chambers.

17. The fireplace of claim 15, wherein the smoke chamber has a first load bearing section having a first proximal edge and a first distal edge, an opposed second load bearing section having a second proximal edge and a second proximal edge, a first inclined section having a first interior surface, and an opposed second inclined section having a second interior surface, wherein the first interior surface is sized to complementarily engage the first proximal edge of the first load bearing section and the second proximal edge of the second load bearing sections, and wherein the second interior surface is sized to complementarily engage the first distal edge of the first load bearing section and the second distal edge of the second load bearing sections, so that the smoke chamber is formed when the first load bearing section, the second load bearing section, the first inclined section and the second inclined are contiguously engaged.

18. The fireplace of claim 15, further comprising a top plate having a top plate upper surface, an opposed top plate lower surface, the top plate defining a top plate bore extending therethrough the top plate between the top plate upper surface and the top plate lower surface, the top plate lower surface disposed onto the smoke chamber top surface so that the top plate bore is in fluid communication with the smoke chamber exhaust opening.

19. The fireplace of claim 18, further comprising a chimney having a first chimney end and a second chimney end, the chimney defining a chimney passage extending therethrough the chimney between the first chimney end and the second chimney end, the first chimney end disposed upon the top plate upper surface so that the chimney passage is in fluid communication with the top plate bore.

20. The fireplace of claim 18, wherein the fireplace is made of a composition of water, crushed pumice, type S mortar and glass fibers.

21. A fireplace comprising:

a first side wall having a first side wall top surface, a first side wall bottom surface, and a first side wall inner surface, the first side wall formed of a plurality of sequentially stacked modular side blocks, each side block having a first horizontally extending side block surface, an opposed second horizontally extending side block surface, a side block proximal end, and an opposed side block distal end, the first side block surface and the second side block surface substantially planer and parallel to each other, each side block defining at least one block bore extending therethrough between the first side block surface to the second side block surface, wherein the first side surface of one modular side block is sized to complementarily engage the second side block surface of the adjacent side block so that the block bore of each side block substantially co-axially aligns with the block bore of the other side blocks in the first side wall to form at least one substantially vertical first air chamber;

a second side wall, having a second side wall top surface, a second side wall bottom, and a second side wall inner surface, the second side wall inner surface facing and spaced apart from the first side wall inner surface, the first side wall and the second side wall defining an interior firebox region having a horizontal longitudinal length, the second side wall formed of a sequentially stacked plurality of the modular side blocks, wherein the block bore of each side block that forms said second side wall substantially co-axially aligns with the block bore of the other side blocks in the second side wall to form at least one substantially vertical second air chamber, and wherein the first wall inner surface and the second wall inner surface have a longitudinal length substantially equal to the longitudinal length of the firebox region.

22. The fireplace of claim 21, wherein each side block defines a plurality of block bores extending therethrough between the first side block surface to the second side block surface, wherein the first side block surface is sized to complementarily engage the second side block bottom surface of the adjacent side block so that the block bores of each side block substantially co-axially aligns with the block bores of the other side blocks in the stacked plurality of modular side blocks to form a plurality of substantially vertical air chambers.

23. The fireplace of claim 22, wherein each block bore is cylindrical in shape.

24. The fireplace of claim 21, further comprising a base having a base upper surface and an opposed base lower surface, the base upper surface is sized to complementarily engage the first side wall bottom surface and the second side wall bottom surface.

25. The fireplace of claim 21, wherein the first side block surface of each side block includes a female indentation therein and the second side block surface of each side block includes a male protrusion extending therefrom, wherein the male protrusion is sized to complementarily engage one female indentation therein.

26. The fireplace construction of claim 21, further comprising a first smoke lip and an opposed second smoke lip, the first smoke lip having a first smoke lip proximal end, an opposed first smoke lip distal end, a first smoke lip inner surface and a first smoke lip outer surface, the first smoke lip inner surface of the first smoke lip proximal end disposed onto the first side block upper surface, proximal the first side block proximal end, of the first side block on top of the first side wall, the first smoke lip inner surface of the first smoke lip distal end is disposed onto the second side block upper surface, proximal the second side block proximal end, of the second side block on top of the second side wall, so that the first smoke lip spans the interior of the firebox region from the first side wall top surface to the second side wall top surface, the second smoke lip having a second smoke lip proximal end, an opposed second smoke lip distal end, a second smoke lip inner surface and a second smoke lip outer surface, the second smoke lip inner surface of the second smoke lip proximal end disposed onto the first side block upper surface, proximal the first side block distal end, of the first side block on top of the first side wall, the second smoke lip inner surface of the second smoke lip distal end is disposed onto the second side block upper surface proximal the second side block distal end, of the second side block on top of the second side wall, so that the second smoke lip spans the interior of the firebox region from the first side wall top surface to the second side wall top surface, and so that the first side wall, the second side wall, the first smoke lip and the second smoke lip define a firebox exhaust opening.

27. The fireplace of claim 25, wherein the first smoke lip and the second smoke lip are made of angled steel with a "L" shaped cross-section.

28. The fireplace of claim 21, further comprising a firebox top having a firebox lower surface disposed on the first side wall top surface, the second side wall top surface, the first smoke lip upper surface and the second smoke lip upper surface so that the interior firebox region is enclosed.

29. The fireplace of claim 26, further comprising a smoke chamber throat having a smoke chamber throat top surface and an opposed smoke chamber throat bottom surface, the smoke chamber throat defining a throat opening extending therethrough between the smoke chamber throat top surface to the smoke chamber throat bottom surface, the smoke chamber throat bottom surface disposed onto the first side wall top surface of the first side wall, the second side wall top surface of the second side wall, the first smoke lip outer surface of the first smoke lip, and the second smoke lip outer surface of the second smoke lip, so that the smoke chamber throat covers the firebox exhaust opening and the throat opening is in fluid communication with the firebox exhaust opening.

30. The fireplace construction of claim 26, further comprising a smoke chamber having a smoke chamber top surface, a smoke chamber bottom surface, the smoke chamber top surface defining a smoke chamber exhaust opening therethrough, the smoke chamber bottom surface disposed onto the first side wall top surface, the second side wall top surface, the first smoke lip upper surface, and the second smoke lip upper surface, the smoke chamber defining an interior smoke chamber region in fluid communication with the firebox exhaust opening, the smoke chamber exhaust opening, the plurality of first air chambers, and the plurality of second air chambers.

31. The fireplace of claim 30, wherein the smoke chamber has a first load bearing section having a first proximal edge and a first distal edge, an opposed second load bearing section having a second proximal edge and a second proximal edge, a first inclined section having a first interior surface, and an opposed second inclined section having a second interior surface, wherein the first interior surface is sized to complementarily engage the first proximal edge of the first load bearing section and the second proximal edge of the second load bearing sections, and wherein the second interior surface is sized to complementarily engage the first distal edge of the first load bearing section and the second distal edge of the second load bearing sections, so that the smoke chamber is formed when the first load bearing section, the second load bearing section, the first inclined section and the second inclined are contiguously engaged.

32. The fireplace of claim 30, further comprising a top plate having a top plate upper surface, an opposed top plate lower surface, the top plate defining a top plate bore extending therethrough the top plate between the top plate upper surface and the top plate lower surface, the top plate lower surface disposed onto the smoke chamber top surface so that the top plate bore is in fluid communication with the smoke chamber exhaust opening.

33. The fireplace of claim 32, further comprising a chimney having a first chimney end, a second chimney end and defining a chimney passage extending therethrough the chimney between the first chimney end and the second chimney end, the first chimney end disposed upon the top plate upper surface so that the chimney passage is in fluid communication with the top plate bore.

34. A fireplace comprising:

a first side wall having a first side wall top surface, a first side wall bottom surface, and a first side wall inner surface, the first side wall formed of a plurality of sequentially stacked modular first side blocks, each first side block having a first side block upper surface, an opposed first side block lower surface, a first side block proximal end, and an opposed first side block distal end, the first side block upper surface and the first side block lower surface substantially planer and parallel to each other, each first side block defining a plurality of first block bores extending therethrough between the first side block upper surface to the first side block lower surface, wherein the first side upper surface is sized to complementarily engage the first side block bottom surface of the adjacent first side block so that the first block bores of each first side block substantially co-axially aligns with the first block bores of the other first side blocks in the first side wall to form a plurality of first air chambers; and a second side wall, having a second side wall top surface, a second side wall bottom, and a second side wall inner surface, the second side wall inner surface facing and spaced apart from the first side wall inner surface, the first side wall and the second side wall defining an interior firebox region, the second side wall formed of a plurality of sequentially stacked modular second side blocks, each second side block having a second side block upper surface, an opposed second side block lower surface, a second side block proximal end, and an opposed second side block distal end, the second side block upper surface and the second side block lower surface are substantially planer and parallel to each other, each second side block defining a plurality of second block bores extending therethrough between the second side block upper surface to the second side block lower surface, wherein the second side upper surface is sized to complementarily engage the second side block bottom surface of the adjacent second side block so that the second block bores of each second side block substantially co-axially aligns with the second block bores of the other second side blocks in the second side wall to form a plurality of second air chambers;

wherein the fireplace is made of a composition of water, crushed pumice, Class C fly ash calcium aluminate, and glass fibers.

35. A fireplace comprising:

a first side wall having a first side wall top surface, a first side wall bottom surface, and a first side wall inner surface, the first side wall formed of a plurality of sequentially stacked modular first side blocks, each first side block having a first side block upper surface, an opposed first side block lower surface, a first side block proximal end, and an opposed first side block distal end, the first side block upper surface and the first side block lower surface substantially planer and parallel to each other, each first side block defining at least one first block bore extending therethrough between the first side block upper surface to the first side block lower surface, wherein the first side upper surface is sized to complementarily engage the first side block bottom surface of the adjacent first side block so that the first block bore of each first side block substantially co-axially aligns with the first block bore of the other first side blocks in the first side wall to form at least one first air chamber;

a second side wall, having a second side wall top surface, a second side wall bottom, and a second side wall inner surface, the second side wall inner surface facing and spaced apart from the first side wall inner surface, the first side wall and the second side wall defining an interior firebox region, the second side wall formed of a plurality of sequentially stacked modular second side blocks, each second side block having a second side block upper surface, an opposed second side block lower surface, a second side block proximal end, and an opposed second side block distal end, the second side block upper surface and the second side block lower surface are substantially planer and parallel to each other, each second side block defining at least one second block bore extending therethrough between the second side block upper surface to the second side block lower surface, wherein the second side upper surface is sized to complementarily engage the second side block bottom surface of the adjacent second side block so that the second block bore of each second side block substantially co-axially aligns with the second block bore of the other second side blocks in the second side wall to form at least one second air chamber;

a first smoke lip and an opposed second smoke lip, the first smoke lip having a first smoke lip proximal end, an opposed first smoke lip distal end, a first smoke lip inner surface and a first smoke lip outer surface, the first smoke lip inner surface of the first smoke lip proximal end disposed onto the first side block upper surface, proximal the first side block proximal end, of the first side block on top of the first side wall, the first smoke lip inner surface of the first smoke lip distal end is disposed onto the second side block upper surface, proximal the second side block proximal end, of the second side block on top of the second side wall, so that the first smoke lip spans the interior of the firebox region from the first side wall top surface to the second side wall top surface, the second smoke lip having a second smoke lip proximal end, an opposed second smoke lip distal end, a second smoke lip inner surface and a second smoke lip outer surface, the second smoke lip inner surface of the second smoke lip proximal end disposed onto the first side block upper surface, proximal the first side block distal end, of the first side block on top of the first side wall, the second smoke lip inner surface of the second smoke lip distal end is disposed onto the second side block upper surface proximal the second side block distal end, of the second side block on top of the second side wall, so that the second smoke lip spans the interior of the firebox region from the first side wall top surface to the second side wall top surface, and so that the first side wall, the second side wall, the first smoke lip and the second smoke lip define a firebox exhaust opening; and a smoke chamber having a smoke chamber top surface, a smoke chamber bottom surface, the smoke chamber top surface defining a smoke chamber exhaust opening therethrough, the smoke chamber bottom surface disposed onto the first side wall top surface, the second side wall top surface, the first smoke lip upper surface, and the second smoke lip upper surface, the smoke chamber defining an interior smoke chamber region in fluid communication with the firebox exhaust opening, the smoke chamber exhaust opening, the plurality of first air chambers, and the plurality of second air chambers.

* * * * *